US012667196B2

(12) United States Patent
Heidmann et al.

(10) Patent No.: US 12,667,196 B2
(45) Date of Patent: Jun. 30, 2026

(54) TILT CONTROL SYSTEM FOR A CHAIR

(71) Applicant: Steelcase Inc., Grand Rapids, MI (US)

(72) Inventors: Kurt R. Heidmann, Grand Rapids, MI (US); Russell T. Holdredge, Alto, MI (US); Olukemi Chrissie Esi Johel, Grand Rapids, MI (US); Gary Karsten, Wyoming, MI (US); Nicholas Miles Krupansky, East Grand Rapids, MI (US); Nickolaus William Charles Deevers, E Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 192 days.

(21) Appl. No.: 18/658,222

(22) Filed: May 8, 2024

(65) Prior Publication Data

US 2024/0349897 A1 Oct. 24, 2024

Related U.S. Application Data

(63) Continuation of application No. PCT/US2022/048620, filed on Nov. 1, 2022.

(60) Provisional application No. 63/277,497, filed on Nov. 9, 2021.

(51) Int. Cl.
*A47C 1/032* (2006.01)
*A47C 7/44* (2006.01)

(52) U.S. Cl.
CPC ..... *A47C 7/443* (2013.01); *A47C 1/03272* (2013.01); *A47C 7/441* (2013.01)

(58) Field of Classification Search
CPC ..... A47C 1/03272; A47C 7/441; A47C 7/443
See application file for complete search history.

(56) References Cited

U.S. PATENT DOCUMENTS

| | | | |
|---|---|---|---|
| 1,909,018 | A | 5/1933 | Sengpiel |
| 2,430,577 | A | 11/1947 | Lorenz |
| 2,941,583 | A | 6/1960 | Tischler et al. |
| 2,981,311 | A | 4/1961 | Hacker |
| 3,008,765 | A | 11/1961 | Tischler et al. |
| 3,897,036 | A | 7/1975 | Nystrom |
| 3,918,822 | A | 11/1975 | Rauschenberger |

(Continued)

FOREIGN PATENT DOCUMENTS

| | | | |
|---|---|---|---|
| CN | 2666265 | Y | 12/2004 |
| CN | 201938822 | U | 8/2011 |

(Continued)

OTHER PUBLICATIONS

International Search Report and Written Opinion for International Application No. PCT/US2022/048620 mailed Mar. 20, 2023 (14 pages)

(Continued)

*Primary Examiner* — Rodney B White
(74) *Attorney, Agent, or Firm* — Benesch Friedlander Coplan & Aronoff LLP

(57) ABSTRACT

A tilt control system includes a spring adjuster and compression spring, which may be removed in an unstressed condition. The tilt control system may also include a variable back stop having curved transition surfaces between the stop surfaces. A lumbar compensator may be integrated into a backrest, which may be coupled with a quick release to the base and actuated by sliding engagement with the seat.

16 Claims, 19 Drawing Sheets

(56) References Cited

U.S. PATENT DOCUMENTS 4,018,415 A 4/1977 Wolters
4,099,775 A 7/1978 Mizelle
4,232,900 A 11/1980 Parker
4,328,943 A 5/1982 Eldon, III
4,345,733 A * 8/1982 Ambasz ..... A47C 7/443 297/303.5 X
4,429,917 A * 2/1984 Diffrient ..... A47C 1/03272 297/300.5 X
4,479,679 A * 10/1984 Fries ..... A47C 1/03255 297/300.7 X
4,653,809 A 3/1987 Willi
4,707,029 A * 11/1987 Korn ..... A47C 3/026 297/300.5 X
4,711,491 A * 12/1987 Ginat ..... A47C 7/445 297/300.5 X
4,720,142 A 1/1988 Holdredge et al.
4,744,600 A * 5/1988 Inoue ..... A47C 3/026 297/300.5 X
4,762,366 A 8/1988 Bauer et al.
4,763,950 A 8/1988 Tobler
4,789,203 A 12/1988 van Zee et al.
4,830,431 A 5/1989 Inoue
4,840,426 A 6/1989 Vogtherr et al.
4,948,198 A * 8/1990 Crossman ..... A47C 7/441 297/303.4
4,966,411 A * 10/1990 Katagiri ..... A47C 31/126 297/300.7 X
5,026,117 A 6/1991 Faiks et al.
5,042,876 A 8/1991 Faiks
5,152,580 A 10/1992 Stumpf
5,207,479 A * 5/1993 Wickman ..... A47C 3/026 297/303.4
5,282,670 A 2/1994 Karsten et al.
5,308,145 A 5/1994 Koepke et al.
5,328,237 A 7/1994 Yamaguchi et al.
5,328,424 A 7/1994 Steffens et al.
5,344,211 A 9/1994 Adat et al.
5,385,388 A 1/1995 Faiks et al.
5,427,434 A * 6/1995 Hybarger ..... A47C 7/443 297/301.4
5,577,807 A 11/1996 Hodge et al.
5,660,439 A 8/1997 Unvalla
5,765,914 A 6/1998 Britain et al.
5,782,536 A 7/1998 Heidmann et al.
5,797,653 A 8/1998 Elzenbeck et al.
5,873,634 A 2/1999 Heidmann et al.
5,971,481 A 10/1999 Emmenegger et al.
5,979,988 A 11/1999 Heidmann et al.
5,997,094 A 12/1999 Cvek
6,059,363 A 5/2000 Roslund, Jr. et al.
6,179,384 B1 1/2001 DeKraker et al.
6,250,715 B1 6/2001 Caruso et al.
6,257,665 B1 7/2001 Nagamitsu et al.
6,394,598 B1 5/2002 Kaiser
6,431,649 B1 8/2002 Hensel
6,439,661 B1 8/2002 Brauning
6,450,577 B1 9/2002 Roslund, Jr.
6,557,939 B1 5/2003 Brauning
6,582,019 B2 * 6/2003 Insalaco ..... A47C 1/03255 297/300.1 X
6,588,843 B1 * 7/2003 Ebenstein ..... A47C 1/031 297/300.2 X
6,598,938 B2 7/2003 Boltze et al.
6,609,755 B2 8/2003 Koepke et al.
6,616,228 B2 9/2003 Heidmann
6,626,497 B2 9/2003 Nagamitsu et al.
6,758,523 B2 7/2004 VanDeRiet et al.
6,761,406 B2 7/2004 Kinoshita et al.
6,769,741 B2 8/2004 Denning
6,779,847 B2 8/2004 Klein
6,880,886 B2 4/2005 Bodnar et al.
6,913,316 B2 7/2005 Kinoshita et al.
6,926,362 B2 8/2005 Kroner et al.
7,014,262 B2 3/2006 Rossetto et al.
7,036,882 B2 5/2006 Elzenbeck
7,080,884 B2 7/2006 Daeschle et al.
7,114,777 B2 10/2006 Knoblock et al.
7,134,722 B2 11/2006 Ueda et al.
7,147,285 B2 12/2006 Lin
7,172,253 B2 2/2007 Haverkamp
7,213,880 B2 5/2007 Schmitz et al.
7,249,801 B2 7/2007 Tonin
7,281,764 B2 10/2007 Thole
7,293,833 B2 11/2007 Takeuchi et al.
7,422,287 B2 9/2008 Heidmann et al.
7,425,037 B2 9/2008 Schmitz et al.
7,441,839 B2 10/2008 Pennington et al.
7,467,826 B1 12/2008 Wen
7,530,637 B1 5/2009 Wu
7,568,763 B2 8/2009 Bedford et al.
7,568,765 B2 8/2009 Brauning
7,604,298 B2 10/2009 Peterson et al.
7,695,067 B2 4/2010 Goetz et al.
7,712,833 B2 5/2010 Ueda
7,712,834 B2 5/2010 Knoblock et al.
7,740,315 B2 6/2010 Ball et al.
7,766,426 B2 8/2010 Meidan
7,794,017 B2 9/2010 Kan et al.
7,798,573 B2 9/2010 Pennington et al.
7,857,389 B2 12/2010 Ueda
7,862,120 B2 1/2011 Ueda
7,866,749 B2 1/2011 Costaglia et al.
7,874,618 B2 1/2011 Kohl et al.
7,931,337 B2 4/2011 Lawall et al.
7,946,651 B2 5/2011 Donati
8,251,448 B2 8/2012 Machael et al.
8,313,143 B2 11/2012 Beyer et al.
8,376,466 B2 2/2013 Kladde
8,662,605 B2 3/2014 McRorie et al.
8,894,150 B2 11/2014 Piretti
8,939,509 B2 * 1/2015 Ni ..... A47C 1/03272 297/300.5 X
8,960,796 B2 2/2015 Aldrich et al.
8,960,799 B2 2/2015 Yoon
8,998,322 B2 4/2015 Horiki et al.
9,004,597 B2 4/2015 Battey et al.
9,027,999 B2 5/2015 Battey et al.
9,155,393 B2 10/2015 Hurford et al.
9,192,234 B2 11/2015 Grove
9,265,348 B2 2/2016 Potrykus
9,357,849 B2 6/2016 Grove
9,504,331 B2 11/2016 Machael et al.
9,510,684 B2 12/2016 Schmitz et al.
9,687,079 B1 6/2017 Grove
9,974,389 B2 * 5/2018 Sander ..... A47C 7/441
10,231,545 B2 3/2019 Moreschi
10,231,546 B2 3/2019 Lowe et al.
10,376,066 B2 * 8/2019 Su ..... A47C 1/03294
10,463,153 B2 11/2019 Peterson et al.
10,485,346 B2 * 11/2019 Jones ..... A47C 1/03238
10,518,667 B2 12/2019 Abe et al.
10,765,212 B2 9/2020 Peterson et al.
11,006,751 B2 * 5/2021 Jones ..... A47C 1/03255
11,759,014 B2 * 9/2023 Ni ..... A47C 1/03266 297/300.1
2001/0013569 A1 8/2001 Donati
2007/0108821 A1 5/2007 Ueda
2007/0290537 A1 12/2007 Lin
2009/0174128 A1 7/2009 Donati
2010/0176636 A1 7/2010 Tai
2011/0233979 A1 9/2011 An
2013/0169017 A1 7/2013 Masunaga et al.
2014/0103688 A1 4/2014 Wilson
2019/0298069 A1 10/2019 Masunaga et al.
2019/0313798 A1 10/2019 Weber et al.

FOREIGN PATENT DOCUMENTS

DE 3700862 A1 7/1988
DE 20 2004 011 519 U1 11/2004
DE 20 2009 002 581 U1 7/2010
EP 0 194 374 B1 5/1989
EP 0 240 389 B1 11/1990

(56) References Cited

FOREIGN PATENT DOCUMENTS

| | | | |
|---|---|---|---|
| EP | 1 353 584 | B1 | 8/2007 |
| EP | 1 992 254 | A1 | 11/2008 |
| EP | 2 070 446 | B1 | 6/2009 |
| EP | 2 477 523 | B1 | 6/2013 |
| EP | 2 661 986 | A1 | 11/2013 |
| EP | 2 298 131 | B1 | 4/2015 |
| EP | 3 172 900 | B1 | 5/2019 |
| EP | 3 253 255 | B1 | 5/2019 |
| GB | 785194 | | 10/1957 |
| GB | 831110 | | 3/1960 |
| GB | 2154275 | | 3/1987 |
| IT | BS20070165 | A1 | 4/2009 |
| JP | 2000-287795 | | 10/2000 |
| JP | 3661560 | | 4/2005 |
| JP | 3721648 | | 9/2005 |
| JP | 3776749 | | 3/2006 |
| JP | 4132718 | | 6/2008 |
| JP | 6220233 | B2 | 10/2017 |
| KR | 10-0713174 | B1 | 4/2007 |
| KR | 10-1034972 | B1 | 5/2011 |
| KR | 10-1123744 | B1 | 3/2012 |
| KR | 10-1387982 | B1 | 4/2014 |
| SE | 1200283 | A1 | 11/2013 |
| TW | I 259068 | | 8/2006 |
| WO | WO 2010/056838 | A1 | 5/2010 |
| WO | WO 2010/103554 | A1 | 9/2010 |
| WO | WO 2013/005883 | A1 | 1/2013 |
| WO | WO 2018/154479 | A1 | 8/2018 |
| WO | WO 2020/007411 | A1 | 9/2020 |

OTHER PUBLICATIONS

ErgoALS , "Ergonomic Desk Chair Lumbar Support Ergonomic Office Chair—SWHIISH" Nov. 5, 2020 (14 pages).

International Preliminary Report on Patentability for International Application No. PCT/US2022/048620 issued May 2, 2024.

* cited by examiner

TILT CONTROL SYSTEM FOR A CHAIR

This application is a continuation of an International Application No. PCT/US2022/048620, filed Nov. 1, 2022, which claims the benefit of U.S. Provisional Application No. 63/277,497, filed Nov. 9, 2021, both entitled TILT CONTROL SYSTEM FOR A CHAIR, the entire disclosures of which are hereby incorporated herein by reference.

FIELD OF THE INVENTION

The present application relates generally to a tilt control system for a chair, and to the method for the use and assembly thereof.

BACKGROUND

Tilt control systems may be incorporated into various body support structures such as office chairs, vehicular and aircraft seating, sofas, beds and other pieces of furniture that provide for kinematic movement. For example, a conventional tilt control may control the relative movement of and between a seat and backrest, and/or provide a biasing return force thereto. The tilt control may also include one or more stops that control the amount of recline of one or both of the seat and backrest. Often, such tilt controls rely on one or more compression, torsion and/or tension springs to provide the biasing return force. Often, such springs are preloaded during assembly, which may make disassembly and replacement thereof difficult. In addition, various mechanisms connecting and supporting a base, seat and backrest may be complicated and include various linkages and mechanisms in order to achieve a particular kinematic motion of one or more of the seat and backrest. Such linkages and mechanisms may be costly and difficult to assemble and disassemble.

SUMMARY

The present invention is defined by the following claims, and nothing in this section should be considered to be a limitation on those claims.

In one aspect, one embodiment of a tilt control system may include a base, a backrest, a compression spring and a spring adjuster. The backrest is pivotally coupled to the base about a first pivot axis, wherein the backrest is pivotable relative to the base between an upright position and a reclined position. The spring adjuster is coupled to the base and includes a vertically moveable coupling component, wherein the coupling component is reciprocally moveable along a first direction. The compression spring includes a first end coupled to the coupling component and a second end coupled to the backrest, wherein the compression spring extends rearwardly from the first end in a second direction transverse to the first direction. The spring is compressible between a first condition when the backrest is in the upright position and a second condition when the backrest is in the reclined position. The second condition includes a greater degree of compression than the first condition.

In another aspect, one embodiment of a tilt control system includes a base and a backrest pivotally coupled to the base about a first pivot axis, wherein the backrest is pivotable relative to the base between an upright position and a reclined position. The backrest includes a stop feature. A stop is pivotally coupled to the base about a second pivot axis spaced apart from the first pivot axis. The stop includes at least first and second stop surfaces and a transition surface extending between the first and second stop surfaces, wherein at least a portion of the transition surface is curved. The stop is pivotable between at least first and second positions. The stop feature is engaged with the first and second stop surfaces respectively when the stop is in the first and second positions so as to limit the pivoting of the backrest relative to the base.

In another aspect, one embodiment of a method of assembling a tilt control assembly includes providing a backrest support connected to the base at a first location, engaging a first end of a compression spring assembly with the base, engaging a second end of the compression spring assembly with the backrest support, and rotating the backrest support relative the base in a first rotational direction. The method further includes moving a stop from a non-engaged position, wherein the stop is not engageable by the backrest support, to an engaged position, wherein the stop engages the backrest support to prevent rotation of the backrest support relative to the base in a second rotational direction opposite the first rotational direction, and rotatably connecting the backrest support and the seat with a connector.

In another aspect, one embodiment of a tilt control system includes a base and a seat pivotally coupled to the base, wherein the seat is pivotable between an upright position and a reclined position. A backrest includes a frame coupled to the base and a flexible shell having an upper portion connected to the backrest frame. A leaf spring is connected to a lower portion of the flexible shell at a first location and is connected to the frame at a second location. The seat slidably engages the leaf spring between the first and second locations as the seat is pivoted from the upright position toward the reclined positions. The seat may further be disengaged from the leaf spring as the seat is pivoted from the upright position toward the reclined position, meaning the seat is no longer in sliding contact with the leaf spring.

In another aspect, a method of assembling a tilt control assembly includes providing a backrest having a frame, a flexible shell having an upper portion connected to the frame, and a leaf spring connected to a lower portion of the flexible shell at a first location and connected to the frame at a second location. The method further includes releasably connecting the frame to a base, which may include a backrest support, and establishing an intermittent sliding contact between the leaf spring and a seat coupled to the base.

The various embodiments of the tilt control system and methods provide significant advantages over other tilt control systems and methods for the manufacture and assembly thereof. For example and without limitation, the return force of the compression spring may be easily and quickly adjusted with the spring adjuster. At the same time, the spring may be installed, removed and/or replaced in an unloaded (e.g., uncompressed) condition, thereby avoiding the need to preload the spring during installation of the spring. The curved portion of the stop provides a smooth transition between stop surfaces, such that the stop feature moves (e.g., slides) smoothly into engagement with one of the stop surfaces, and does not bind on the stop member. Moreover, the interface between the backrest and base and/or seat provides an integrated user interactive backrest, while minimizing the complexity and number of parts interfaced therebetween, and providing for a quick release attachment of the backrest to the base, via the backrest support in one embodiment.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
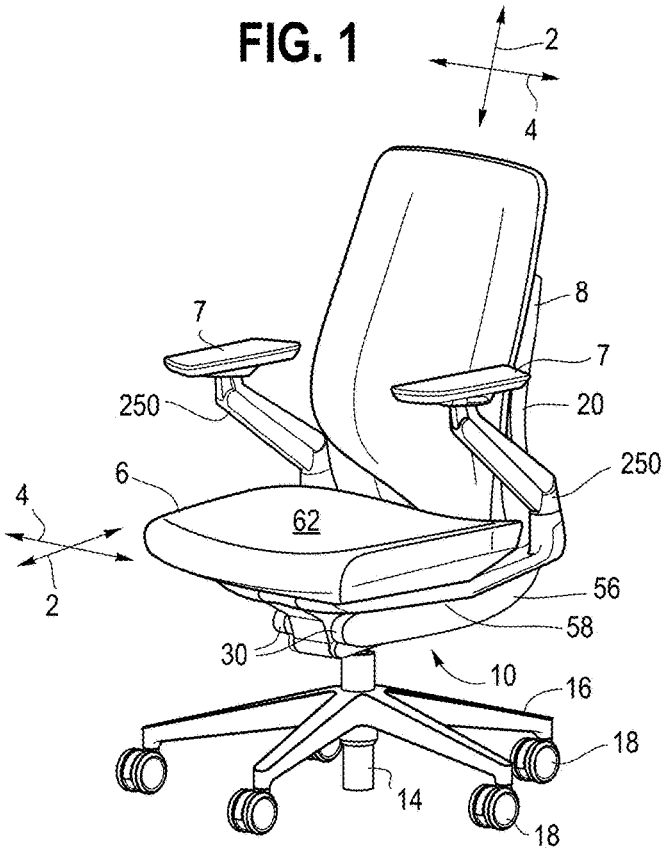
FIG. 1 is a perspective view of on embodiment of a chair.

It should be understood that the term "plurality," as used herein, means two or more. As shown in FIG. 1, the term "longitudinal," as used herein, means of or relating to a length or lengthwise direction 2, for example a direction running from a top to bottom of a backrest 8, or a front to back of a seat 6, and vice versa (bottom to top and back to front. The term "lateral," as used herein, means situated on, directed toward or running in a side-to-side direction 4 of the backrest or seat. The term "coupled" means connected to or engaged with whether directly or indirectly, for example with an intervening member, and does not require the engagement to be fixed or permanent, although it may be fixed or permanent. The term "fixed" means not moveable. The terms "first," "second," and so on, as used herein, are not meant to be assigned to a particular component or feature so designated, but rather are simply referring to such components and features in the numerical order as addressed, meaning that a component or feature designated as "first" may later be a "second" such component or feature, depending on the order in which it is referred. It should also be understood that designation of "first" and "second" does not necessarily mean that the two components, features or values so designated are different, meaning for example a first direction may be the same as a second direction, with each simply being applicable to different components or features. The terms "upper," "lower," "rear," "front," "fore," "aft," "vertical," "horizontal," and variations or derivatives thereof, refer to the orientations of the exemplary body support structure as shown in FIG. 1 from the perspective of a such sitting thereon. The phrase "body support structure" refers to a structure that supports a body, including without limitation office furniture, home furniture, outdoor furniture and vehicular seating, including automotive, airline, marine and passenger train seating, and may include without limitation beds, chairs, sofas, stools, and other pieces of furniture or types of seating structures.

Referring to FIGS. 1-4, 16, and 20A and B, the seat 6 and backrest 8 are supported by a tilt control mechanism 10, which includes a base 12, which may be configured as a tilt control housing, a seat support 32 and a backrest support 30, with the base, seat support and backrest support defining different components of the tilt control mechanism. The base 12 is configured with a floor 68 and a pair of side walls 70. The base 12, and the floor 68 in one embodiment, includes a hub 72 that is coupled to and supported by a support column 14, which is supported in turn by a bottom base 16 configured with one or more floor engaging components 18, such as glides, casters or other types of feet. The bottom base 16 may be configured with multiple legs. Alternatively, the base 12 may be supported by other types of support platforms and legs, including a sled base, fixed legs (e.g., 2 or more), a pedestal support, rocker support or other suitable support platforms.

Figure 18:
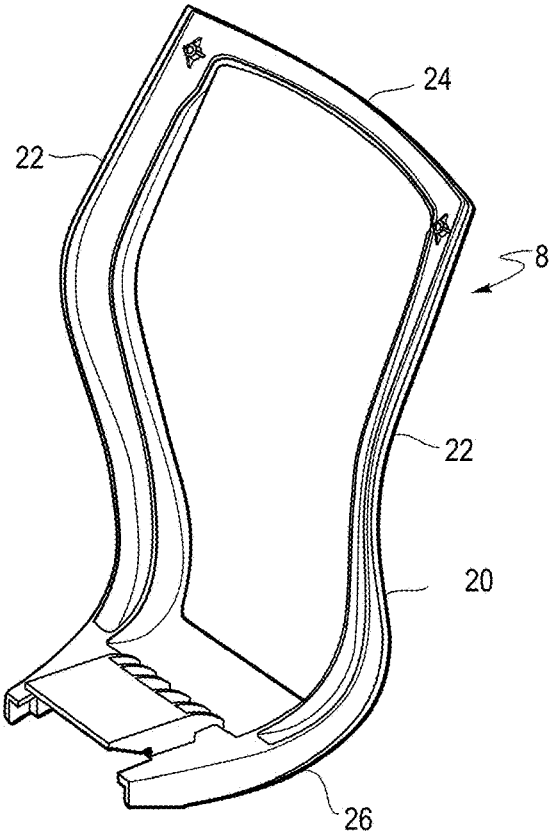
FIG. 18 is a perspective view of the backrest frame.
Figure 20A:
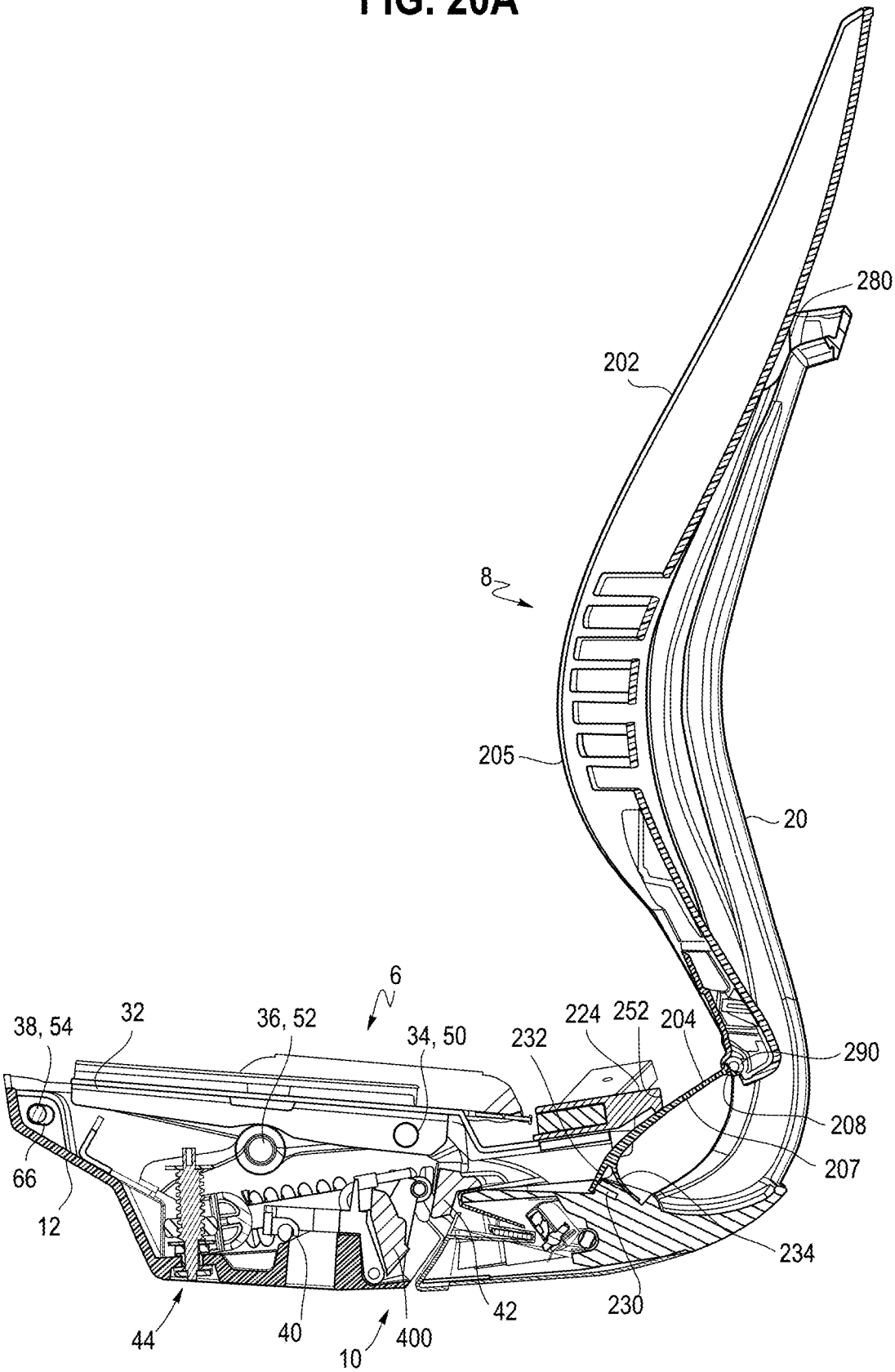
FIGS. 20A and B are partial side views of a body support structure in an upright position and a reclined position.

Referring to FIGS. 18 and 20A, the backrest 8 includes a frame 20 configured with a pair of laterally spaced apart uprights 22. In one embodiment, the frame has a top cross member 24 extending laterally between the uprights 22, and a bottom cross member 26 extending laterally between the uprights 22, with the top and bottom cross members 24, 26 being longitudinally spaced.

Figure 2:
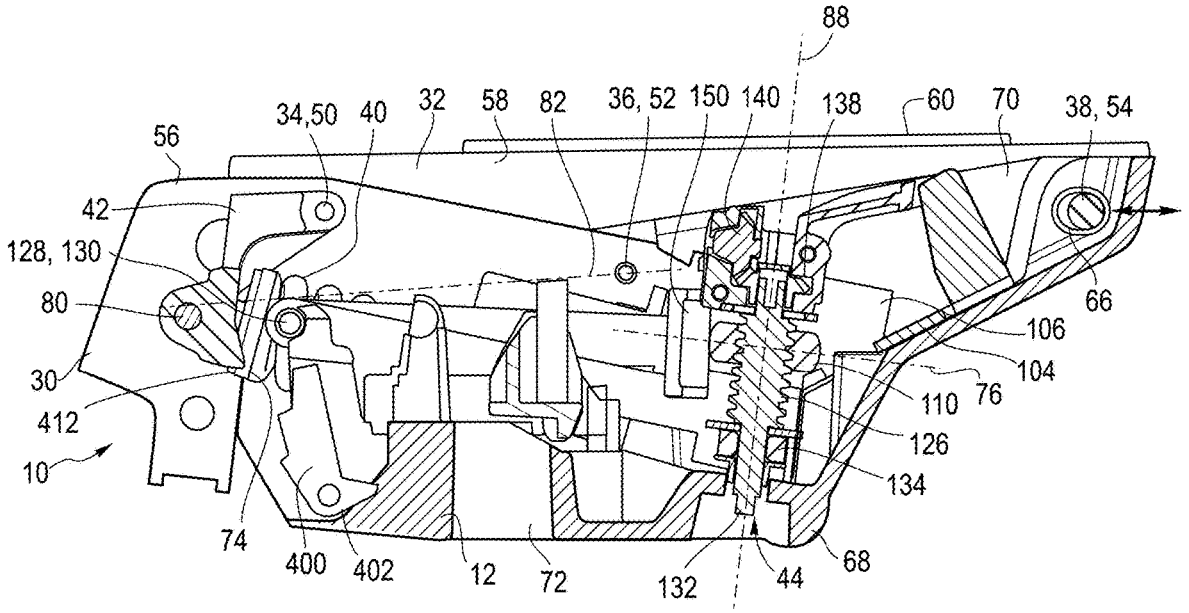
FIG. 2 is a cross-sectional side view of one embodiment of a tilt control.
Figure 3:
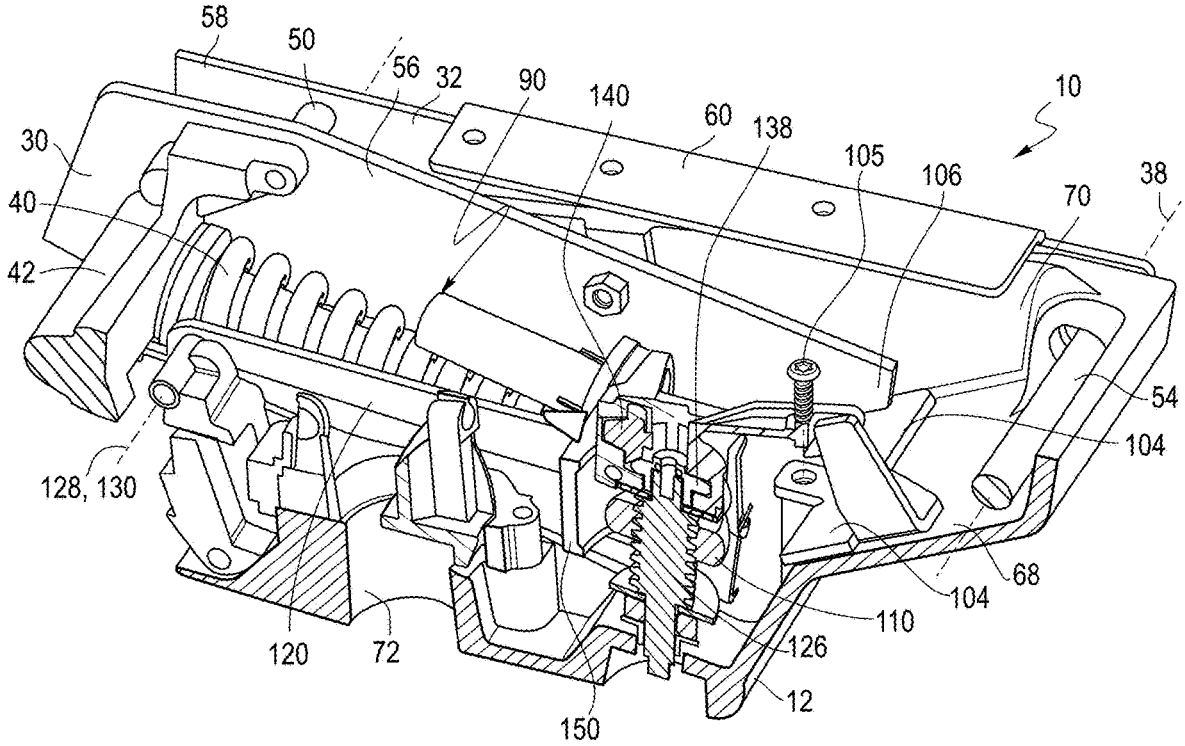
FIG. 3 is cross-sectional perspective view of the tilt control shown in FIG. 2.
Figure 4:
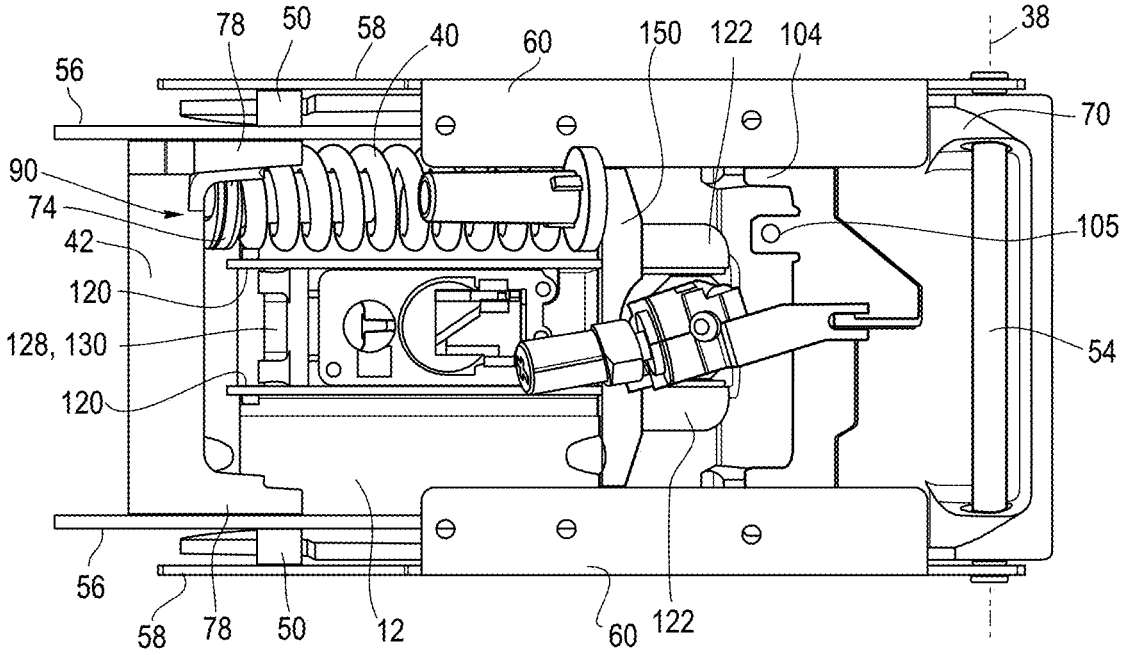
FIG. 4 is a top view of the tilt control shown in FIG. 2.

Referring to FIGS. 2-4, the backrest support 30 is pivotally/rotatably coupled to a seat support 32 at a pivot axis 34 with a connector, for example a shaft or axle 50, configured for example as a rivet or pin, and is pivotally/rotatably connected to the base 12 at a pivot axis 36 with a connector, for example a shaft or axle 52, configured for example as a rivet or pin, or other suitable connector. In one embodiment, the backrest support is configured as a pair of laterally spaced arms 56, while the seat support includes a pair of laterally spaced, vertical walls 58 or flanges, with corresponding pairs of laterally spaced arms 56 and walls 58 joined with a pair of the axles 50. The seat support 32 includes a pair of horizontal flanges 60 extending laterally inwardly from the walls, with the flanges providing a mounting platform for a body supporting seat component 62. The seat support 32, and the walls 58 in particular, are pivotally and slidably connected to the base 12 at a forward pivot/slide axis 38, defined for example by a shaft or axle 54, configured in one embodiment as a pin or other suitable connector, which extends between the walls 58 in one embodiment. In other embodiments, the seat support may be secured to the base with a pair of laterally spaced pins, or other suitable connectors. The pivot axis 34 is positioned rearwardly of the pivot axis 36, while the pivot axes 34, 36 are both positioned rearwardly of the pivot axis 38. In one embodiment, the third pivot axis 38, or connector defining the axis, is slidably or translatably coupled to the base 12, such that as the backrest 8 and seat 6 are reclined, the pivot axis 38 moves rearwardly in a slot 66 defined by the base. It should be understood that, in another embodiment, the seat 6, or seat support 32, may be configured with a slot that slidably engages a connector, such as an axle or shaft, positionally fixed to the base 12, with the connector defining the pivot axis 38.

A compression spring 40 has a rearward end 74 that is engaged with and biases, or applies a force to, a bracket or cross member 42 coupled to and defining in part the backrest support 30. In one embodiment, the cross member 42 extends laterally between the arms 56, and has a pair of mounting platforms 78 engaging the axles 50. The spring 40 extends along and defines a longitudinal axis 76, as shown for example in FIGS. 7A-C and 10A-C. The spring 40 pivots about a pivot axis 81. The orientation, or angle, of the spring 40 and axis 76 relative to an axis 82 extending between the axis 81 and the axis 36 may be altered by a spring adjuster 44. In this way, the system provides for a moment arm shift of the spring to vary the amount of return force applied by the spring assembly.

Figure 7A:
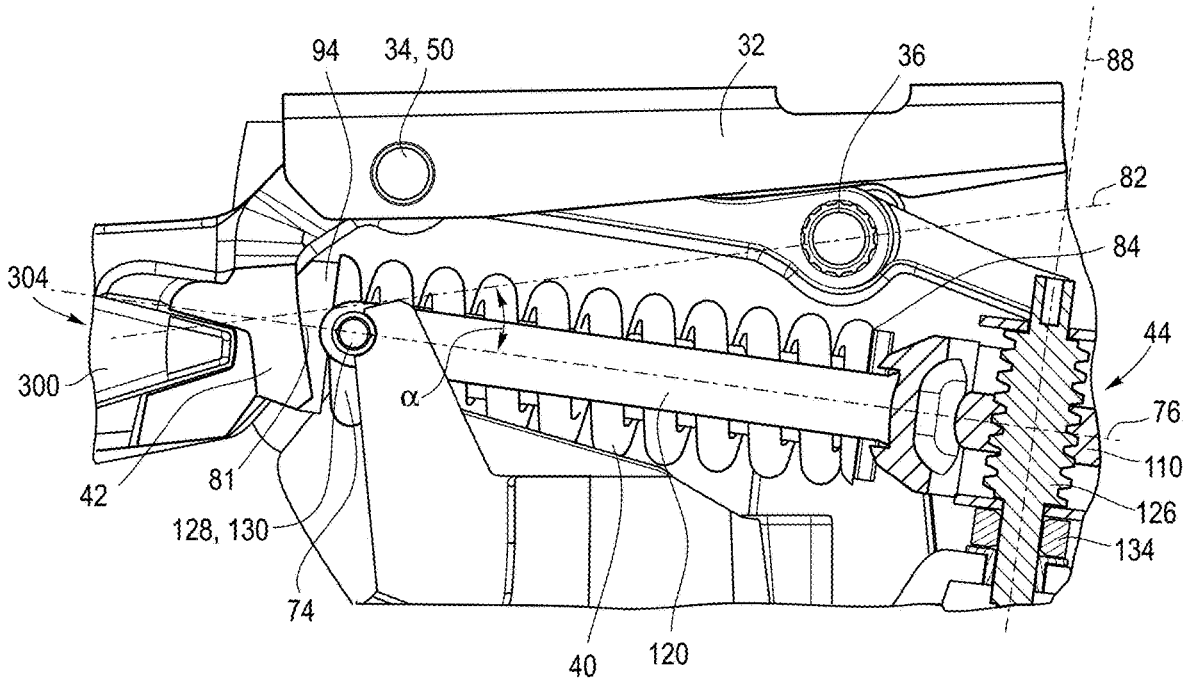
FIG. 7A-C are a partial, cross-sectional side views of the spring adjuster in an intermediate, high and low biasing configurations.
Figure 7B:
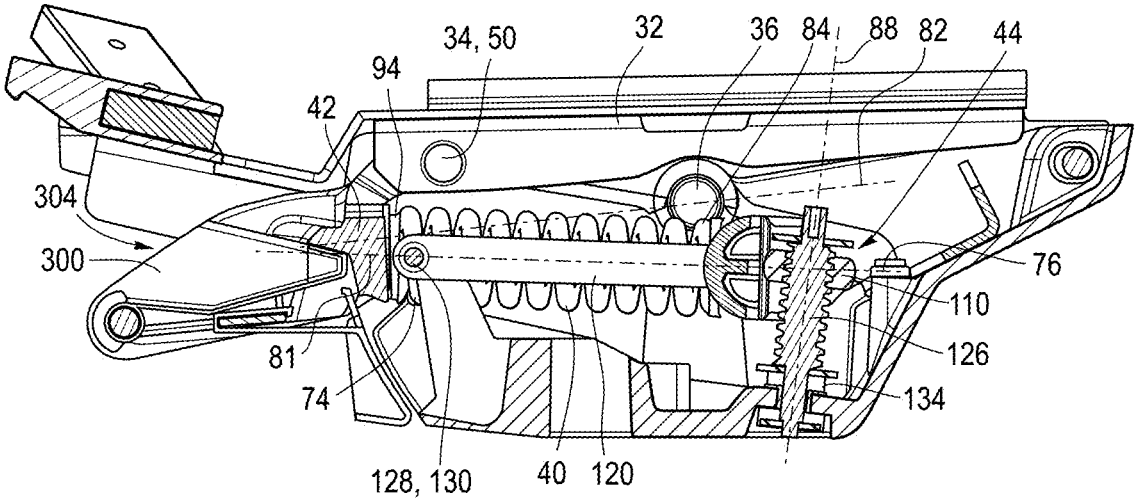
Figure 7C:
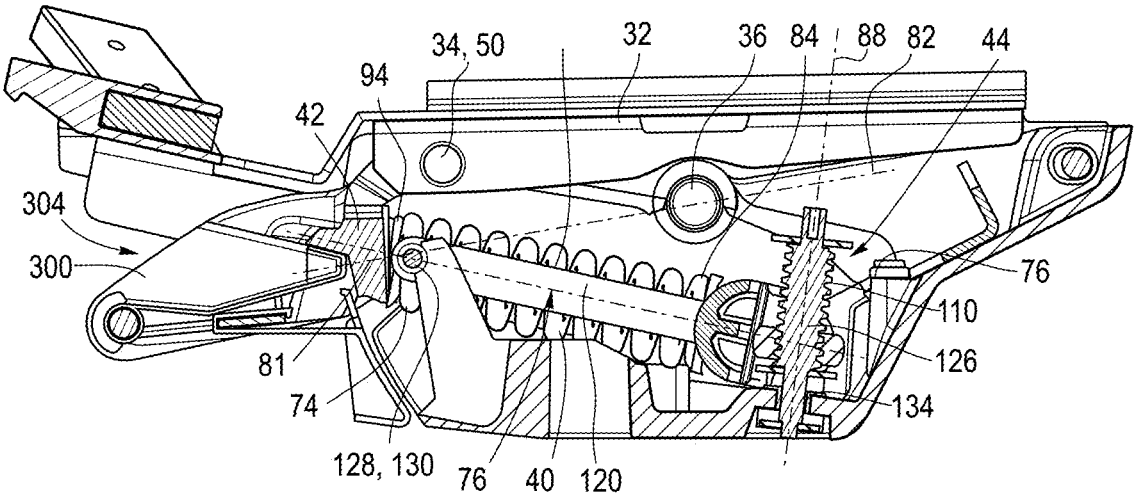
Figure 7D:
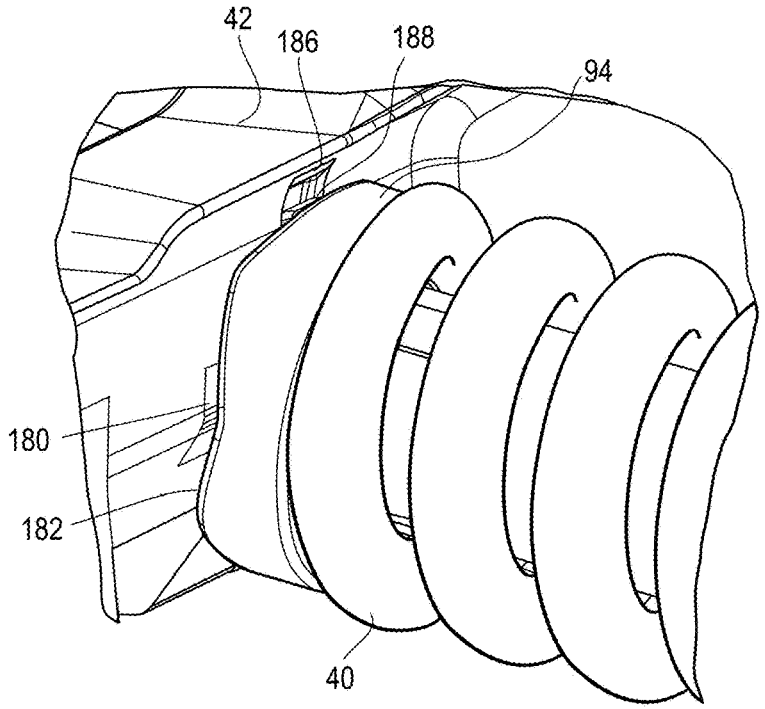
FIG. 7D is a partial, perspective view of the spring adjuster.

Referring to FIGS. 1-5, an opposite, forward end 84 of the spring 40 is engaged/coupled to an adjustable bracket 86, which may be moved vertically along an axis 88, orthogonal to the axis 76, such that the forward end 84 of the spring 40 is moved toward/away from the pivot axis 36 as the spring 40 is pivoted about the axis 80. The spring 40 exerts a greater force against the backrest support 30, and cross member 42 in particular, the further the forward end 84 of the spring is moved away from the pivot axis 36 (i.e., moved downwardly), or put another way, a greater force is applied to the backrest support as the angle $\alpha$ between the axes 76, 82 increases. For example, a maximum biasing force is applied to the backrest support when the spring is positioned as shown in FIG. 7B, while a minimum biasing force is applied to the backrest support when the spring is positioned as shown in FIG. 7C.

Figure 10A:
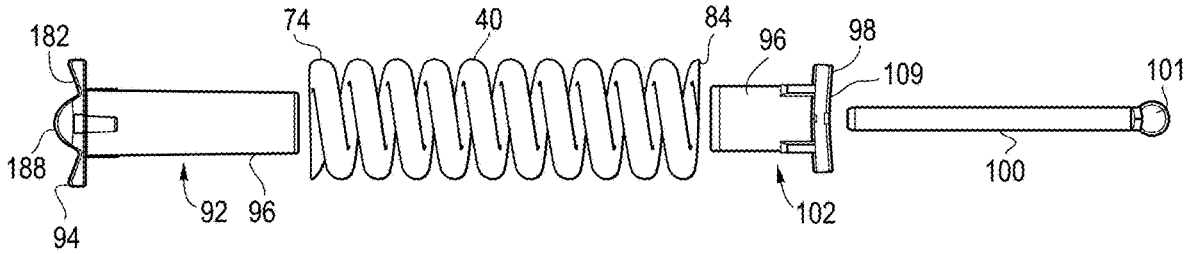
FIG. 10A is an exploded view of the spring assembly.
Figure 10B:
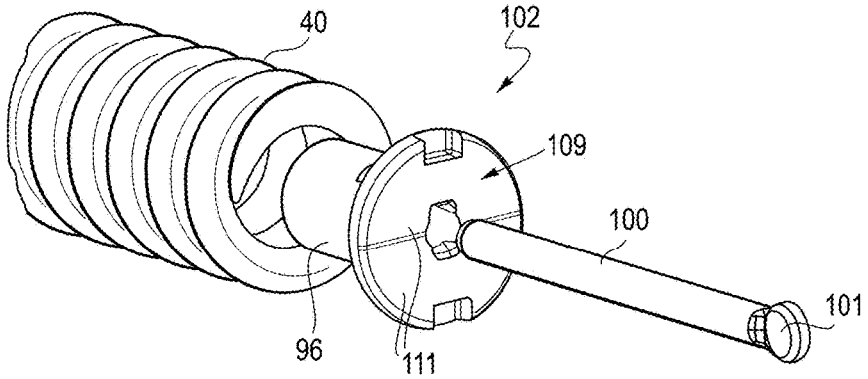
FIG. 10B is a partial, exploded end view of the spring assembly.
Figure 10C:
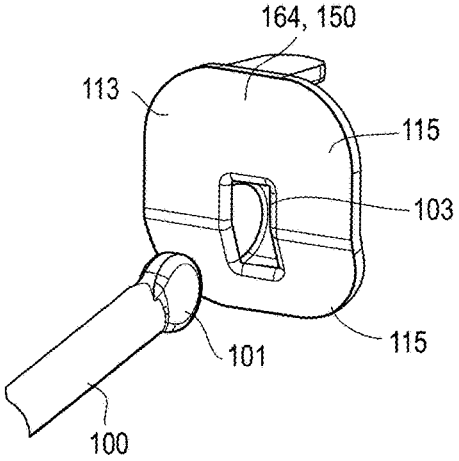
FIG. 10C is a partial, exploded end view of the spring assembly engaging the base.
Figure 11:
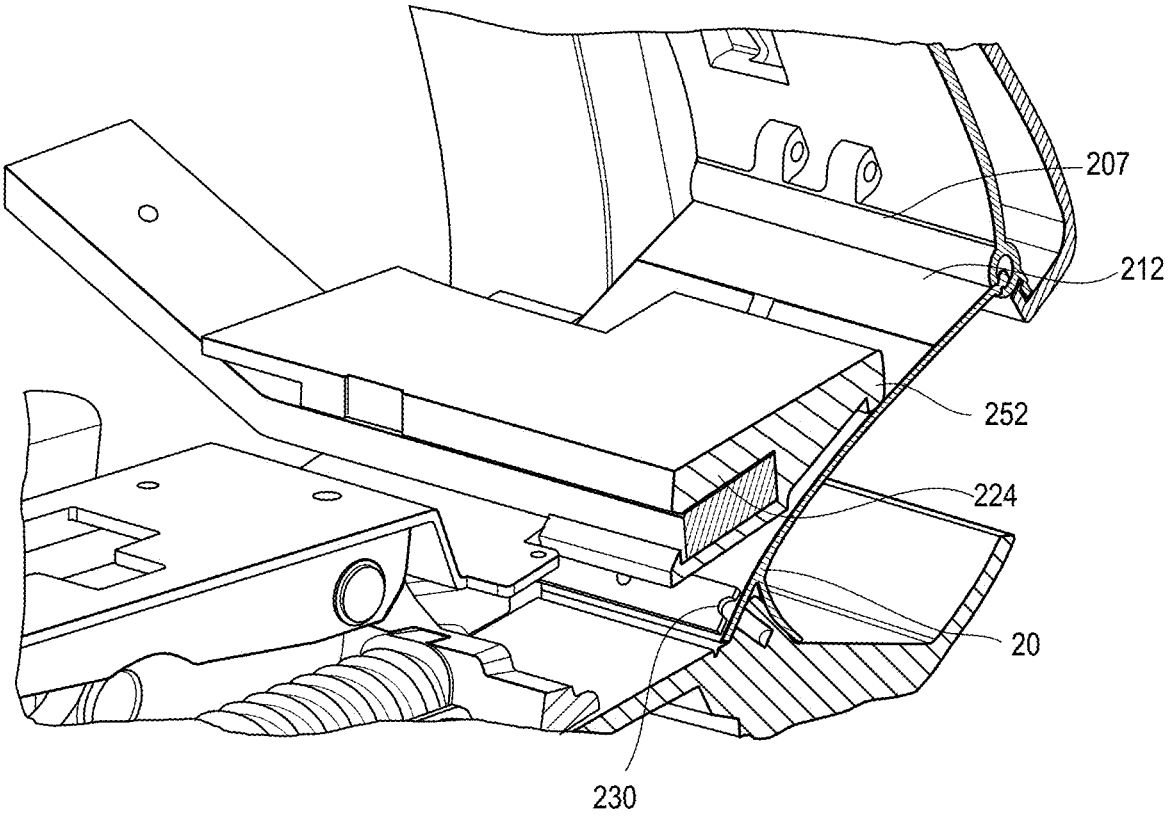
FIG. 11 is a partial rear, perspective view of the backrest and tilt control, with the leaf spring shown in an unloaded configuration.

To prevent buckling of the spring 40, a compression spring assembly 90 includes the spring 40 and a spring holder, which includes opposite caps 92, 102, or first and second components, each having a head portion 94, 98 and a post portion 96. A shaft 100, or pin (i.e., third component), extends between the post portions 96 of the caps, and is slidably received in an axial opening formed in each post portion, as shown in FIGS. 8A and 10A-C. The shaft 100 is of sufficient length such that the shaft 100 remains engaged with the caps 92, 102 in all positions and configurations of the compression spring assembly. An end portion 101 may be flattened, or otherwise shaped to define a key member that is received in an opening 103, such as a slot. The end portion 101 may extend from either of the caps 92, 102 to be received in a key opening. The post portions 96 and shaft 100 are inserted interiorly of the spring 40, with the caps 92, 102 and pin/shaft 100 being moveable (e.g., slidable or translatable) relative to each other along the axis 76 as the spring 40 compresses and elongates during use. The caps 92, 102, and the head portions 94, 98 in particular, engage the ends 74, 84 of the spring 40 and hold the spring between the caps. In the embodiment of FIG. 8B, the bearing surface of the cap 102 has a convex surface. The phrase "convex surface" refers to a surface that is curved, rounded or protrudes outwardly, and may include curved and/or linear surfaces. For example, a pair of linear surfaces intersecting or meeting at an apex may define a convex surface. Conversely, the phrase "concave surface" refers to a surface that is curved, rounded or protrudes inwardly, and may include curved and/or linear surfaces. For example, a pair of linear surfaces intersecting or meeting at inwardly extending recess may define a concave surface. In the embodiment of FIG. 10A-C, the bearing surface of the cap has a concave surface. It should be understood that FIG. 3 shows only a single spring assembly, but that the tilt control may be configured with a pair of spring assemblies.

Figure 19A:
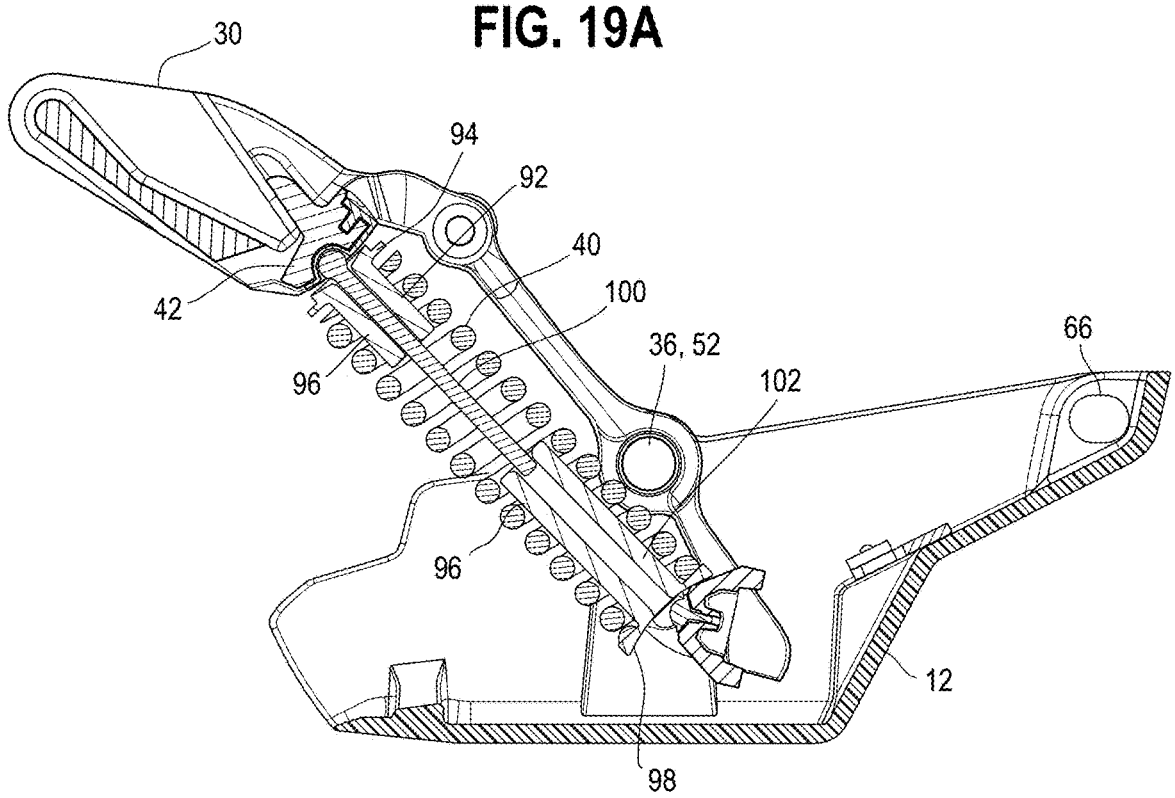
FIGS. 19A and B are side views of the spring assembly being installed, with the backrest support in first and second positions and the spring assembly in a non-compressed and compressed configuration respectively.
Figure 19B:
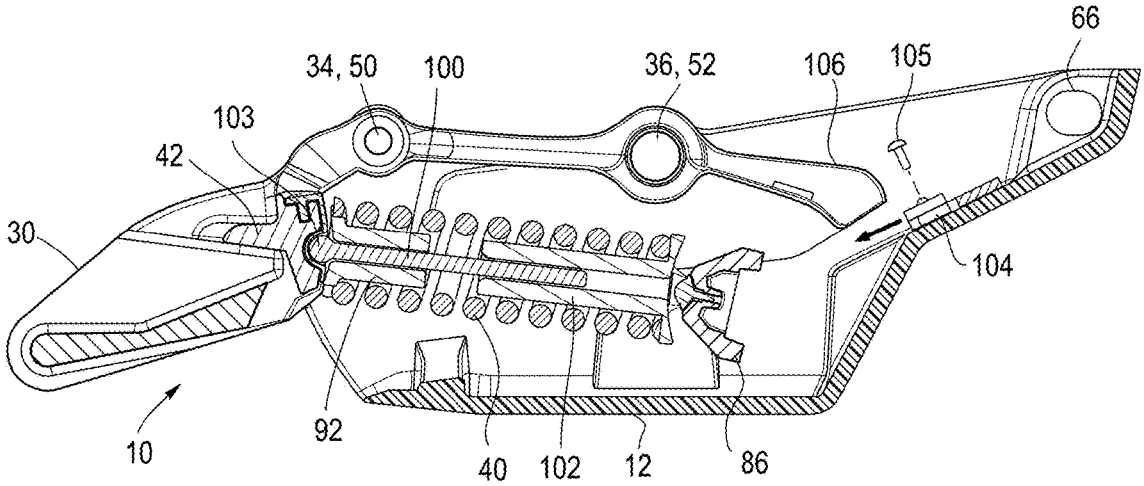

As shown in FIG. 19A, the backrest support 30 is in a first position wherein the backrest support is pivotally connected to only the base 12 at axis 36. A spring assembly 90 may be inserted by moving the spring assembly 90 until a first end of the spring assembly (e.g., head portion 98) engages the spring adjuster 44 and a second end engages the back support, or cross member 42, when the back support is in the first position. The backrest support 30 may then be lowered (pivoted downwardly or in a first counterclockwise rotational direction when viewed from the right-hand side as shown in FIGS. 2, 3, 19A and 19B) such that the the spring assemblies 90 are compressed between the backrest support (e.g., cross member 42) and the base 12. The backrest support 30 is provided with a slight pre-load, or rearward biasing force, applied by the spring 40. The pre-load is created by compressing the spring 40 with the cross member 42 by rotating the backrest support 30 counterclockwise (when viewed from the right), and then sliding a bracket stop 104, configured as a plate in one embodiment, under a forward end 106 of the backrest support arm, positioned forwardly of the pivot axis 36, to prevent the backrest support 30 from rotating clockwise and thereby relieving the pre-load as shown in FIG. 19B. In this way, the stop 104 defines the upright position of the backrest support 30. A fastener 105 may be installed through an opening in the stop 104 and coupled to the underlying base 12 such that the stop is fixed to the base. After the backrest support 30 is engaged by the stop 104, the seat may be coupled to the base 12 and to the backrest support 30, without any requirement to preload the springs or other component, thereby providing for a safe and reliable assembly. Instead, the seat, and in particular the seat support 32, is simply coupled to the base 12 and backrest support 30 with the axles 50, 54 at axes 34, 38 respectively.

The shafts/rivets or axles 50 and stop 104 may be removed such that the backrest support 30 may be separated from (e.g., pivoted relative to) the seat support 32 and pivoted (clockwise when viewing from the right as shown in FIG. 2) about the axis 36 relative to the base 12. The spring assemblies 90 may then be removed by sliding or moving the spring assemblies 90 out of engagement with from the spring adjuster 44 and backrest support 30, e.g., the cross member 42. Conversely, a new or replacement spring assembly 90 may be inserted by moving the spring assembly 90 until a first end of the spring assembly (e.g., head portion 98) engages the spring adjuster 44 and a second end engages the back support, or cross member 42, when the back support is in the vertical/loading position shown in FIG. 19A. In this way, the spring assemblies 90 may be easily inserted, and replaced if damaged, or replaced with stronger or weaker springs depending on the user's needs. The backrest support 30 may then be again lowered (pivoted downwardly or in a first counterclockwise rotational direction when viewed from the right-hand side as shown in FIG. 2) such that the cross member 42 engages and compresses the spring assemblies 90. The bracket stop 104 may then be slid or moved under the forward end 106 of the backrest support arm, positioned forwardly of the pivot axis 36, to prevent the backrest support 30 from rotating clockwise and thereby relieving the pre-load. The fastener 105 may be installed through the opening in the stop 104 and coupled to the underlying base 12 such that the stop 104 is fixed to the base.

Figure 9:
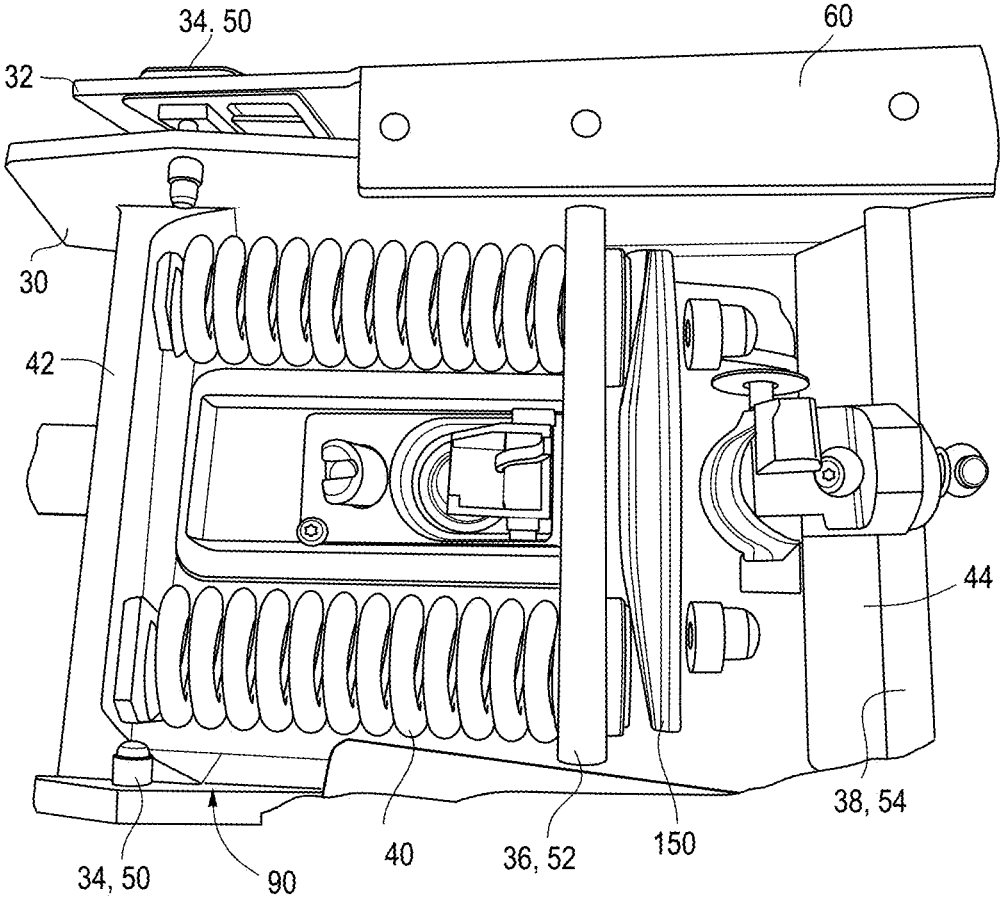
FIG. 9 is a top view of the tilt control, including the spring adjuster.

In one embodiment, a method of assembling a tilt control assembly includes connecting the backrest support 30 to the seat 6, for example the seat support 32, with an axle 50 or pin, wherein the backrest support is connected to the base 12 at a location (e.g., pivot axis 36) spaced from the axle 50. The stop 104 is connected to the base 12 in an engaged position, for example with fasteners 105 such as screws, tabs or other suitable connectors. The stop 104 engages the backrest support 30, and the forward end 106 in particular, in the engaged position to prevent forward rotation of the backrest support 30 relative to the base 12 in a first direction (e.g., clockwise when viewed from the right side). The compression spring assembly 90 may be disposed between the base 12 (e.g., spring adjuster 44) and the backrest 8 (e.g., cross member 42) in a compressed state. A method of replacing the spring assemblies includes removing the axle 50 connecting the backrest support 30 and the seat 6 (e.g., seat support 32), moving the stop 104 from the engaged position to a non-engaged position, for example by removing the fasteners or other connectors. In the non-engaged position, the stop 104 is not engageable by the backrest support 30, such that the backrest support 30 may be rotated relative to the base 12 in the first direction (clockwise when viewed from the right side) and thereby transitioning the compression spring assembly 90 to a non-compressed state as shown in FIG. 19A. The compression spring assembly 90 may then be removed from engagement with the base. It should be understood that the tilt control assembly may be configured with a single compression spring assembly, a pair of spring assemblies as shown in FIG. 9, or more than two spring assemblies. A replacement compression spring assembly 90 may then be engaged with the base 12, for example with the spring adjuster 44, and with the backrest support, with the backrest support 30 then being rotated in a second direction (e.g., counterclockwise when viewed from the right) opposite the first direction so as to thereby compress the replacement compression spring assembly 90, or assemblies, to the compressed state with the backrest support 30. Thereafter, the stop 104 may be moved to the engaged position and secured to the base 12, for example with fasteners 105 or other connectors. The axle 50 or rivet may be installed, or reinstalled, so as to connect the backrest support 30 and the seat 6, for example the seat support 32. This process allows a user/installer to insert/remove the spring assemblies 90 in an unloaded condition, which improves the overall safety of the system and reduces costs associate with the equipment required to load/install springs.

The backrest 8, via the backrest support 30, is pivotable relative to the base 12 between an upright position and a reclined position. The spring adjuster 44 is coupled to the base 12 and includes a vertically moveable coupling component 110, which is reciprocally moveable along a first direction or axis 88, approximating a vertical axis in one embodiment. It should be understood that the term "direction" without a modifier (e.g., rearward, forward, upward or downward) refers to a line or axis, rather than a vector, meaning for example a first direction may extend up or down, or forward and backward. The end 84 of the compression spring 40 is coupled to the coupling component 110 and the second end 74 of the spring 40 is coupled to the backrest 8, for example the cross member 42 of the backrest support. In one embodiment, the coupling component 110 is configured as a nut. The compression spring 40 extends rearwardly from the end 84 in a second direction or along an axis 76 transverse to the first direction or axis 88. The spring 40 is compressible between a first condition when the backrest 8 is in the upright position and a second condition when the backrest 8 is in the reclined position. The second condition has a greater degree of compression than the first condition. In one embodiment, the first condition may have no compression, or a slight compression due to the pre-load of the spring.

Figure 7E:
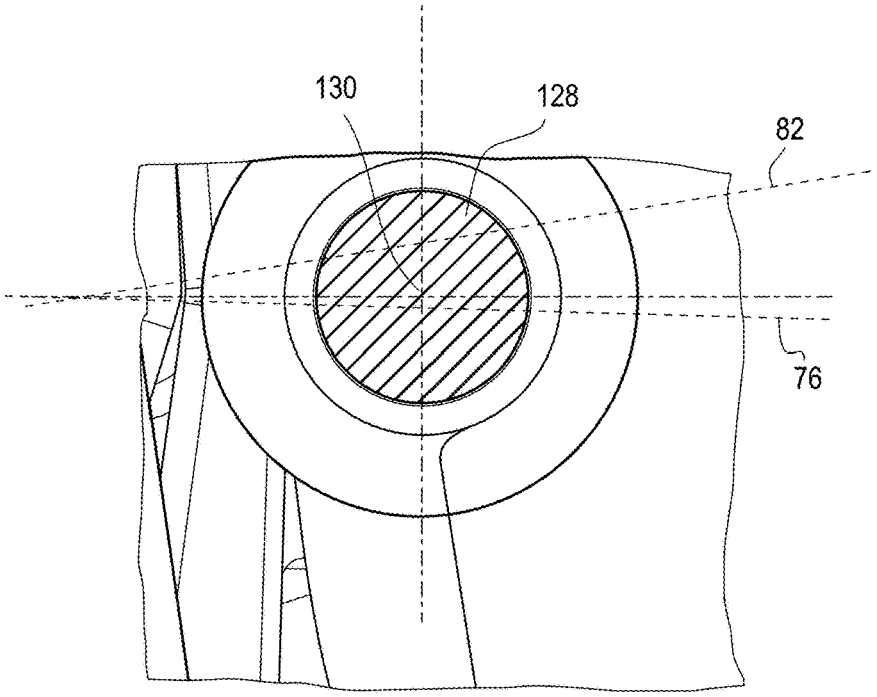
FIG. 7E is an enlarged partial view of a link pivot relative to a spring axis.

The tilt control system also includes pair of links 120 having a first end 122 coupled to the coupling component 110 and a second end 124 coupled to the base with an axle 128, for example a pin or rivet, about a pivot axis 130. As shown in FIG. 7E, the axis 130 is maintained above the axis 76 through all relative movements and adjustments of the compression spring assembly 90 and links 120. The links 120 extend rearwardly from the first end 122 of the link in the second direction. It should be understood that a single link may be suitable. In one embodiment, the spring adjuster 44 may include a vertically extending shaft 126 rotatably mounted to the base 12. The shaft 126 may be threaded. The coupling component 110, configured as a nut in one embodiment, is threadably engaged by the shaft 126. A bottom portion 132 of the shaft is rotatable seated in and supported by the base 12 by a bushing or bearing 134. An upper portion of the shaft includes a bevel gear 138, which is meshed with a bevel gear 140 supported by the base. The bevel gear 138 may include a square shaped opening that receives a square shaped shaft. An actuator rotates the bevel gear 140, which in turn meshes with and rotates the bevel gear 138 and rotates the shaft in first or second opposite directions. As the shaft 126 is rotated in the opposite first and second rotational directions, the threads engage the coupling component 110, causing the coupling component to raise or lower along the axis 88, and thereby raise or lower the end 122 of the link 120 and the end 84 of the compression spring. In one embodiment, the end 122 of the link 120 is pivotally coupled to the coupling component 110 or nut about an axis 142 defined by an axle 144.

The end 122 of the link 120 includes a laterally extending support platform 150, or adjustable bracket 86, and a pair of laterally spaced and longitudinally extending flanges 152 that are pivotally connected to the coupling component 110 by way of the axle 144. The spring 40, and in particular the cap 102, or first component, pivotally engage the coupling component 110 through the intervening end 122 of the link 120, and the support platform 150 in particular. The springs 40 may alternatively be directly engaged with the coupling component. In one embodiment, one of the cap 102 or the coupling component, or support platform 150 (adjustable bracket 86) connected thereto, may be configured with a concave surface 160, while the other of the first component and the coupling component, or support platform 150 (adjustable bracket 86), is configured with a convex surface 162 interfacing with the concave surface 160. A bearing 164 may be disposed between the convex and concave surfaces 162, 160. The bearing may include a key member 166, which is received in a slot 170 defined in the support platform 150 (adjustable bracket 86) as shown in FIG. 8B. The sliding interface between the convex and concave surfaces 162, 160, and bearing 164, allow the springs 40 to rotate relative to the coupling component 110. In one embodiment, as shown in FIGS. 10A-C, the cap 102, and the head portion 98 in particular, is configured with a concave bearing surface 109, which may be defined by a pair of flat surfaces 111 angled relative to each other. The support platform 150, or a bearing coupled thereto, is configured with a convex surface 113, defined in one embodiment by a pair of flat surfaces 115 angled relative to each other, and with a slot formed therein to receive the end portion 101 of the compression spring assembly. The pivot axis of the spring, and spring assembly, is defined by the interface between the concave and convex surfaces 109, 113, as those surfaces slide and/or pivot relative to each other.

Figure 8A:
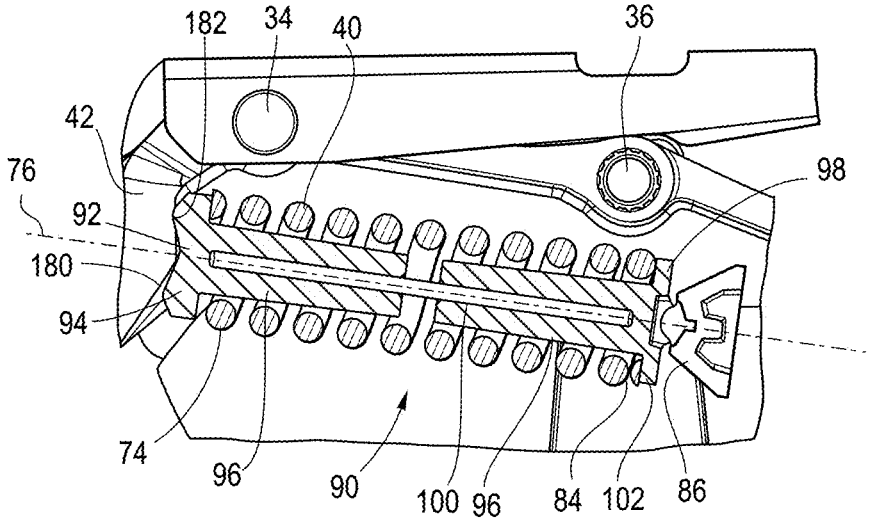
FIG. 8A is a partial, cross-sectional view of the spring assembly.
Figure 8B:
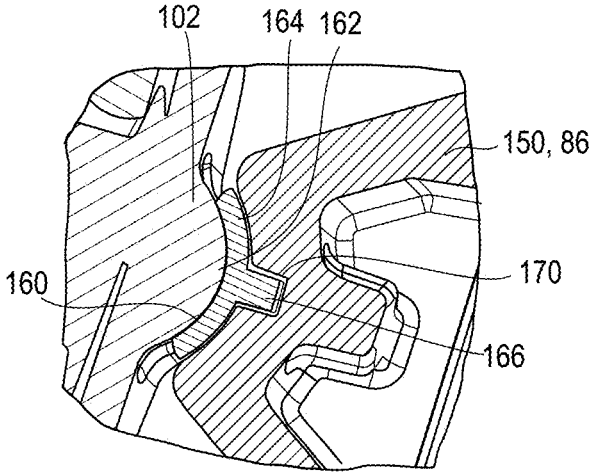
FIG. 8B is a partial view of a portion of the spring assembly.

Now referring to FIGS. 7B and 8A, the cap 92, or second component, may pivotally engage the backrest 8, and the back support 30 cross member 42 in particular. In one embodiment, one of the cap 92 and/or the backrest, e.g., cross member 42, is configured with a concave surface 180 and the other of the second component and the backrest is configured with a convex surface 182 interfacing with the concave surface. For example, the head portion 94 of the cap may have an indentation defining a concave surface, which may be defined by inwardly sloping surfaces. The surfaces may be linear or curved. The cross member 42 may have an apex defining the convex surface 182, and may be defined by one or more linear or curved surfaces. The support member may also have a slot 186 or opening that receives a key member 188, or insert portion or flattened portion 103, extending rearwardly from the head to locate and maintain the relative positions of the spring assembly and cross member 42 as shown in FIG. 19B. The cross member 42 may include a bearing defining the convex surface. The pivot axis 80 of the spring is defined by the interface between the concave and convex surfaces 180, 182, as those surfaces slide and/or pivot relative to each other.

In operation, the spring 40 is compressed between the base 12 and the backrest 8, or the backrest support 30. In particular, the first end of the spring is biased against the support platform 150, or adjustable bracket 86, which is connected to the base 12 with the links 120. The compressive load of the spring 40 is carried to the base 12 by the links 120, rather than through the spring adjuster 44. The other end of the spring is biased against the cross member 42 of the backrest support 30.

Figure 12A:
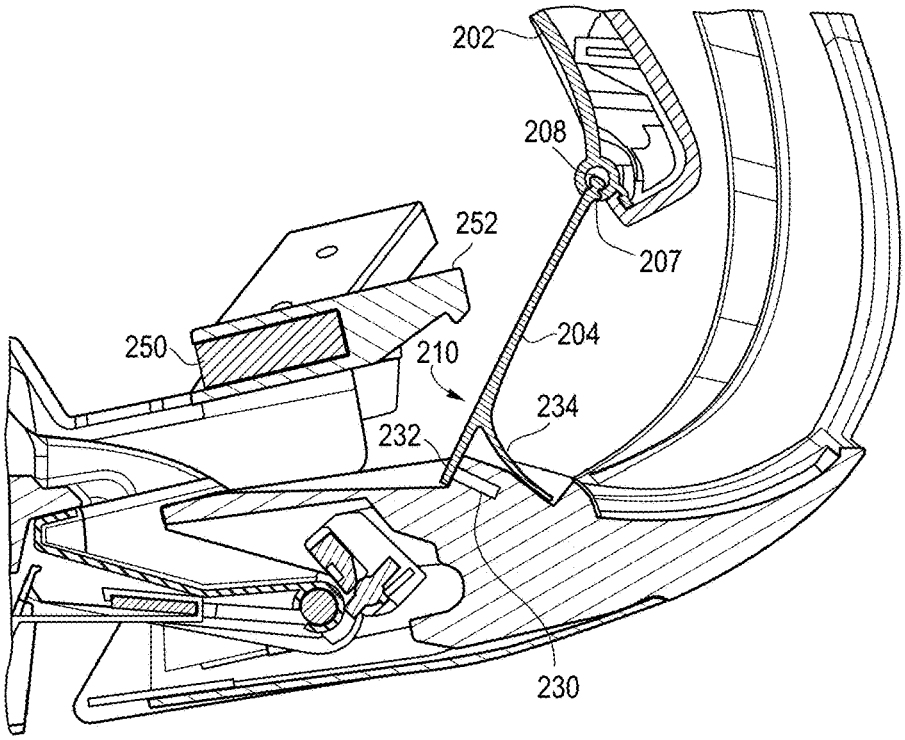
FIGS. 12A and B is a partial, cross-sectional view of the backrest and tilt control with the leaf spring in an unloaded configuration and preloaded configuration respectively.
Figure 12B:
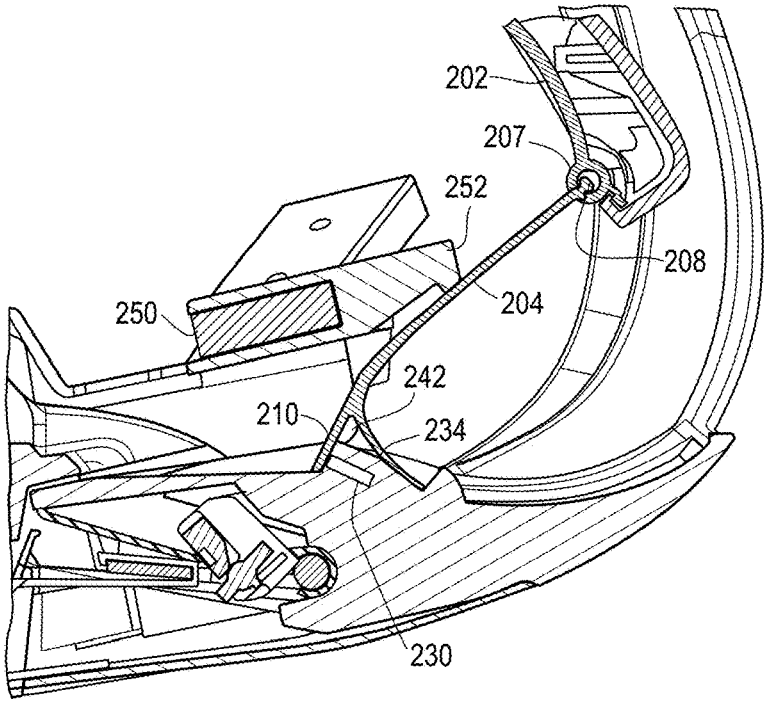
Figure 13:
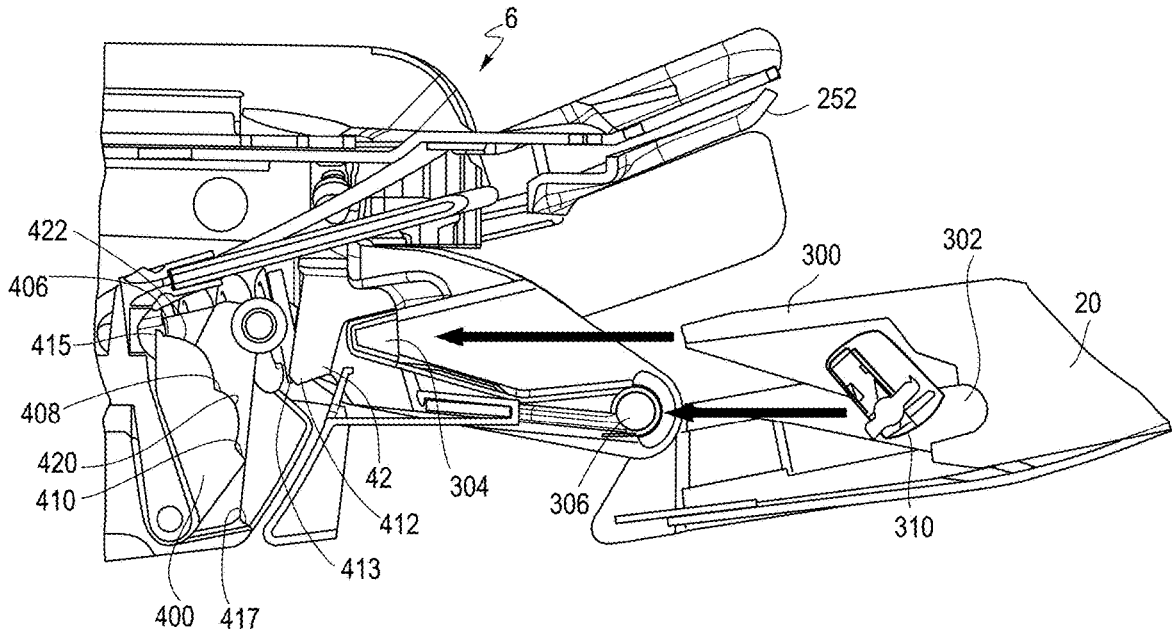
FIG. 13 is a partial side view of the backrest being installed on the tilt control.
Figure 14:
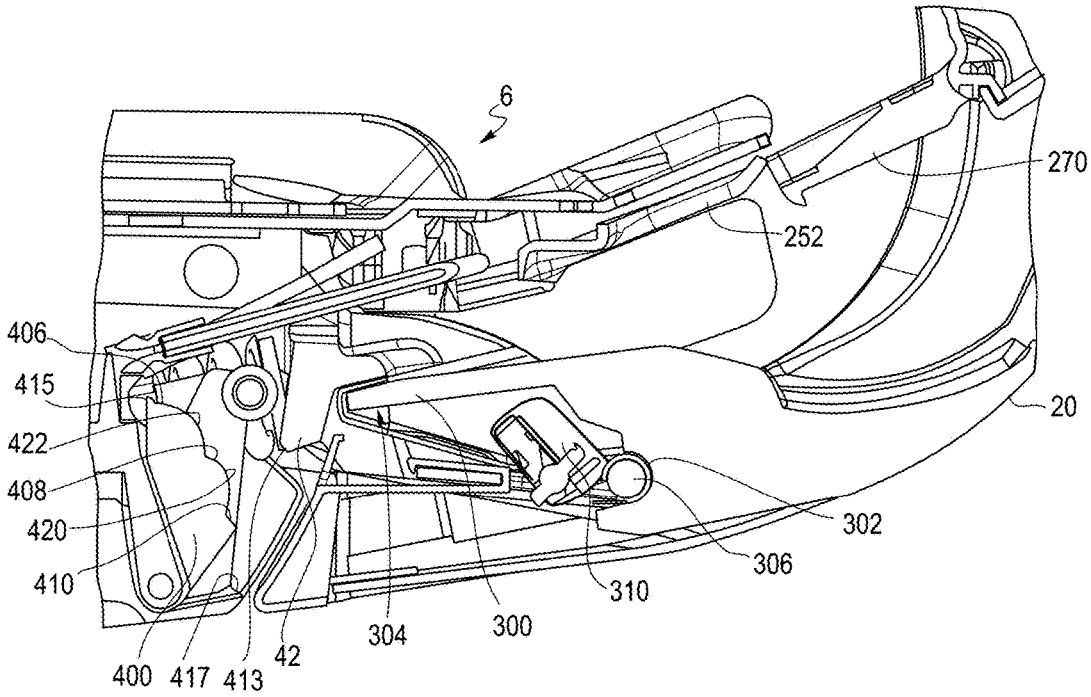
FIG. 14 is a partial side view of the backrest installed on the tilt control.
Figure 15:
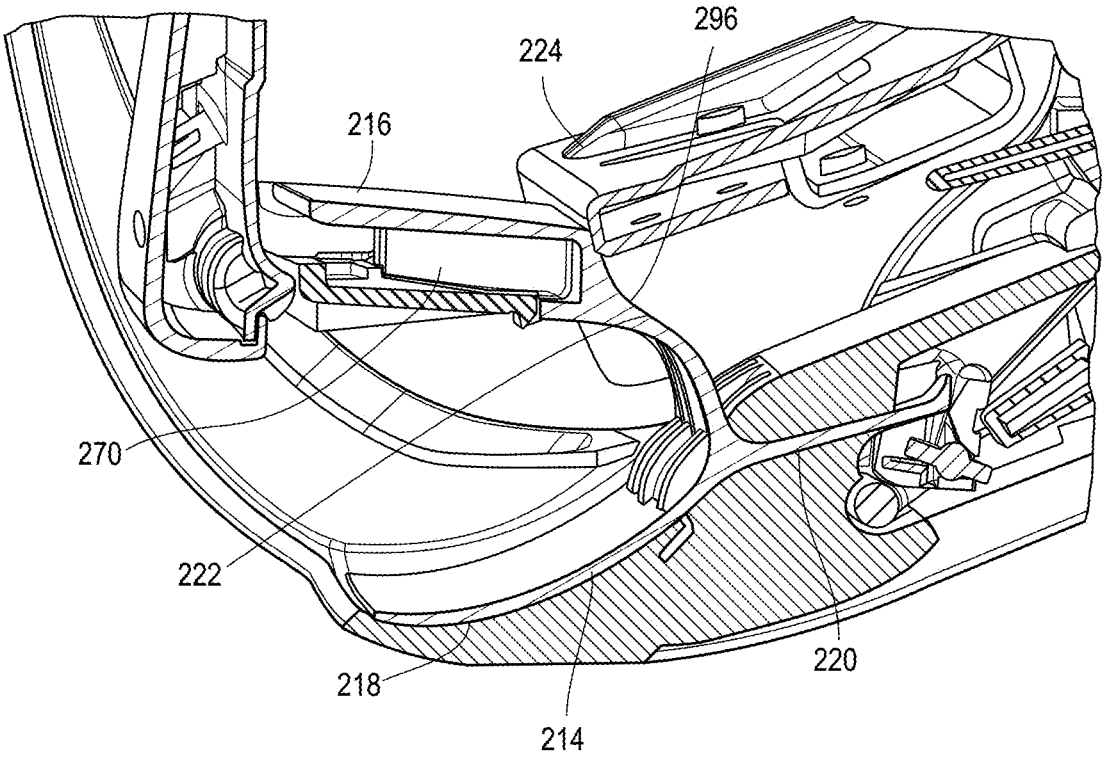
FIG. 15 is a partial, perspective view of the backrest installed on the tilt control.
Figure 20B:
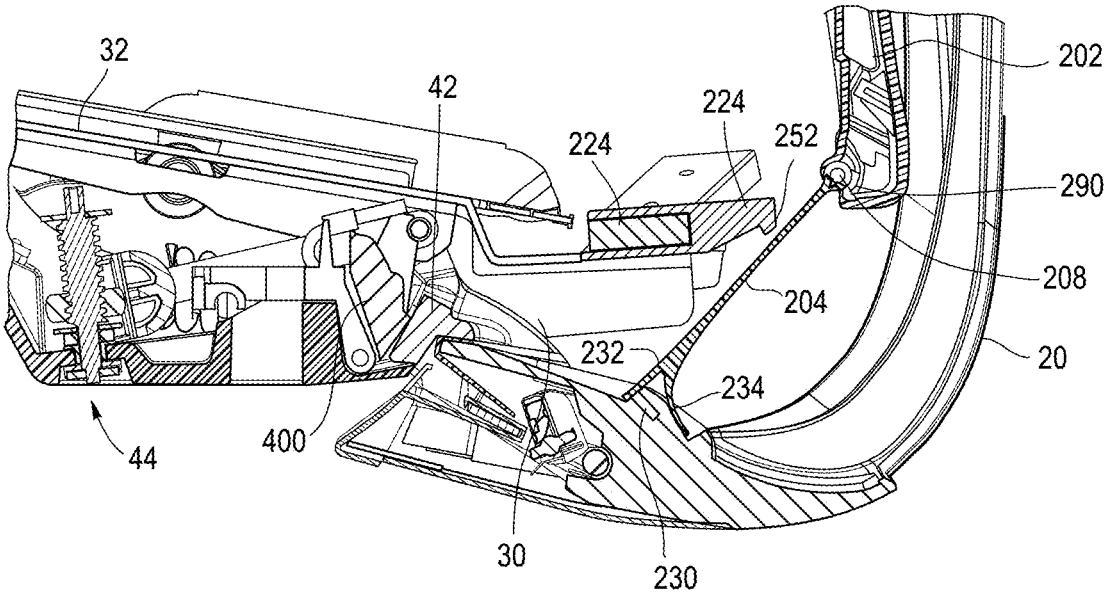

Referring to FIGS. 12A-16 and 20A and B, a lumbar compensator 200 is configured to apply upward pressure to a back shell 202 to cause the lumbar region of the back shell to bow further outward toward the front of the chair when the seat is reclined, thereby providing additional compensation, and filling the space behind the user's lumbar, for lumbar support during recline. The lumbar compensator 200 includes a compliant component 204 (e.g., a leaf spring) pivotally connected to the back shell 202 at a rear end 207 of the spring at a pivot axis 208. A front, or bottom, end 210 of the compliant component 204 is fixedly (non-pivotally) connected to the back frame 20. In other embodiments, the compliant component 204 may be pivotally connected to the back frame 20. In one embodiment, the compliant component 204 includes a plastic shell 212 with a thin leaf spring inlay, which may be made of metal or composite material, captured at one end by the shell 212. The compliant component shell 212 is pivotally connected to the bottom of the back shell 202, although the compliant component 204 may be non-pivotally connected to the back shell 202. In an alternative embodiment, shown in FIG. 15, the compliant component 204 is configured as a unitary one-piece component 214 with an upper portion 216 engaging a pivot member 270 connected to the back shell, a rear leg 218 nesting in the back frame and a front leg 220 coupled to the backrest support, with the upper portion having a curved biasing portion 222 that may be flexed through engagement with the seat 6, or a rearwardly extending pre-load member 224. In FIGS. 12A and 20B, the compliant component 204 is shown in an un-flexed position, for example a reclined position wherein the seat has disengaged from the compliant component.

In one embodiment, the compliant component 204 is pivotally connected to the back shell 202 about pivot axis 208, while the leaf spring or bottom end 210 of the compliant component are fixedly, or non-rotatably, secured to the back frame 20, for example with a plurality of fasteners 230. In some embodiments, the bottom of the compliant component is forked, with a bottom portion 232 fixed to the back frame, and a rearwardly and downwardly extending flange 234 bearing against and sliding along the back frame. The flange 234 provides an additional biasing force or stiffness to the compliant component. The flange 234 also functions as a pinch point cover, preventing a user from inserting one or more fingers or other foreign objects between the compliant component 204 and the back frame 20.

Figure 5:
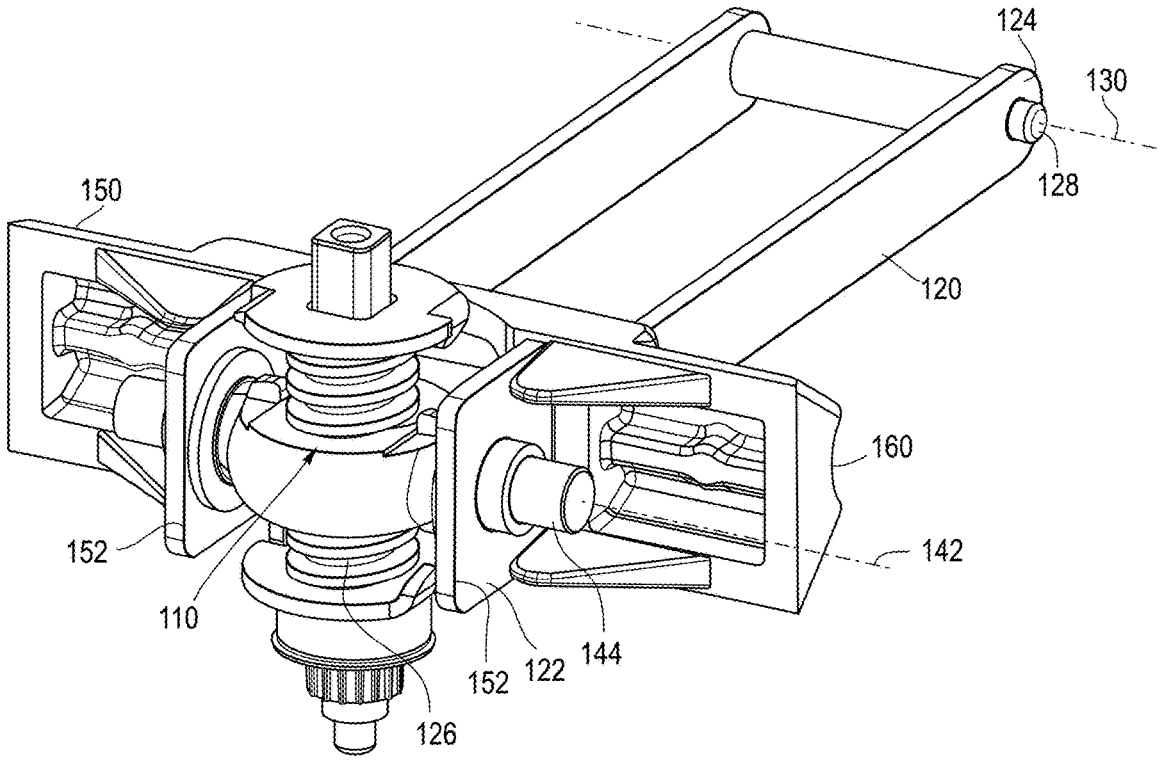
FIG. 5 is a perspective view of the spring adjuster.
Figure 6:
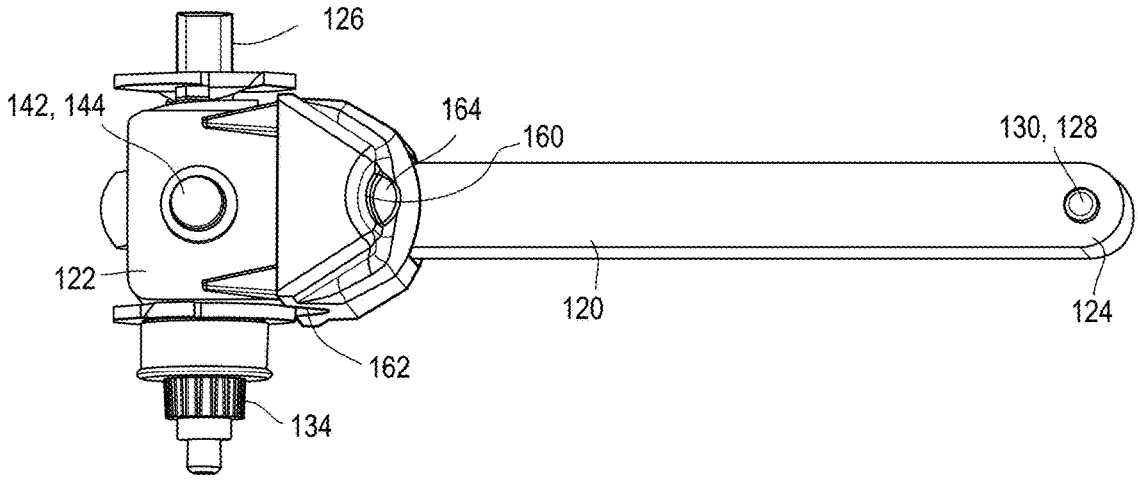
FIG. 6 is side view of the spring adjuster.

The compliant component 204 bends about a fulcrum 242 defined by the back frame 20, and has a bow shape when engaged by the seat, or component thereof. The preload member 224 extends rearwardly from the seat, by way of a coupling to an arm assembly 250, and includes a nose portion 252 that engages the compliant component, or spring. The arm assembly 250 includes a cross member and a pair of armrests extending upwardly along opposite sides of the seat 6. The arm assembly 250 is secured to and moves with the seat 6. The preload member 224 slides along the upper surface of the compliant component 204 as the backrest and seat recline, with the compliant component 204 applying an upward force on the bottom of the back shell 202 to increase the curvature of the lumbar region. Once the back is reclined far enough, as shown in FIG. 5, the preload member 224, or other seat component, is pulled away from, and disengages from or no longer engages, the compliant component 204, or leaf spring.

Figure 16:
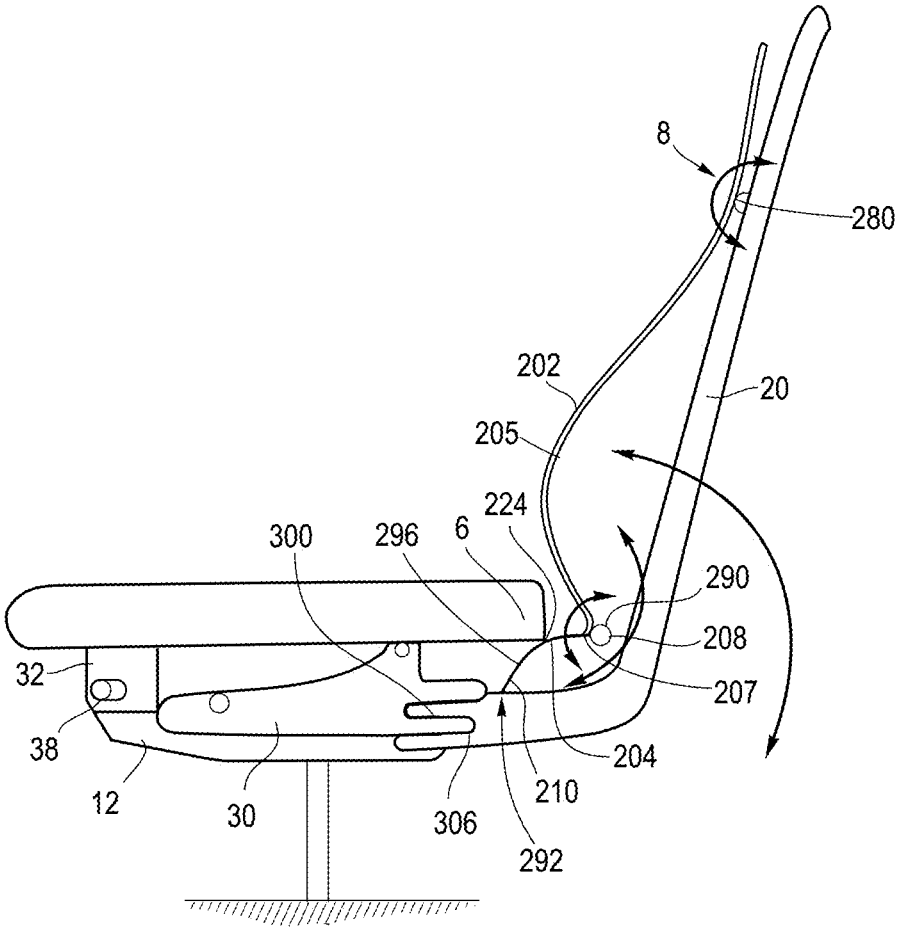
FIG. 16 is side view of the chair in a reclined position.

Referring to FIG. 16, as the user reclines in the chair, a gap or distance between a lumbar region 205 and the user's back may increase in the absence of a lumbar compensator. The lumbar compensator 200, however, continuously applies a force to the shell 202, pushing a bottom of the shell upwardly at the pivot axis 208 and thereby causing the shell to bow forwardly at the lumbar region 205, with the apex of the bowed portion also moving upwardly. As the preload member 224, or other seat component, slides along and eventually disengages from the compliant component 204 during recline, the lumbar compensator progressively pushes on a bottom of the shell, such that the curvature of the lumbar region 205 is maximized and pushed forwardly to accommodate for the increasing distance between the user and the lumbar region. This motion ensures contact with, and support for, the user at the lumbar region 205, or filling/bowing of the lumbar region 205, through the entire recline motion. Of course, during operation, the user may push on the lumbar with their back, thereby causing the lumbar to flatten and bend/flex the compliant component 204.

In one embodiment, and referring to FIGS. 20A and B, the tilt control mechanism 10, or tilt control system, includes the base 12, back support 30, and the seat support 32/seat 6 pivotally coupled to the base, wherein the seat is pivotable between an upright position and a reclined position. The backrest 8 includes the frame 20. The backrest frame 20 is coupled to the base 12, via a component such as the backrest support 30. A flexible shell 202 includes an upper portion pivotally connected to the backrest frame 20, for example at pivot axis 280. In other embodiments, the upper portion may be non-pivotally connected to the backrest frame, but with the shell elastically bending and conforming to the shape of the user's back and in response to a force from a compliant component. The leaf spring, or compliant component 204, is connected to a lower portion of the flexible shell at a first location 290 and is connected to the frame at a second location 292. The seat 6, for example the pre-load member 224, slidably engages the leaf spring between the first and second locations 290, 292 as the seat is pivoted from the upright position (FIG. 20A) toward the reclined position (FIG. 20B). The leaf spring may be bowed, or have a convexly curved surface 296 facing upward and engaged by the seat, or pre-load member. In one embodiment, the seat may disengage from the leaf spring as the seat is pivoted toward the reclined position as shown in FIG. 20B.

In one embodiment, the backrest frame 20 includes a first engagement member or insert portion, configured as a tapered tab 300, and a pocket 302. The tilt control mechanism 10, including the base 12, and in one embodiment a component such as the backrest support 30 connected thereto, includes a pocket 304 and a second engagement member or insert portion, configured as a laterally extending shaft 306 or pin. The tab 300 is removably received in the pocket 304 and the shaft 306 is removably received in the pocket 304 as the backrest frame 20 is moved in a longitudinal forward direction relative to the backrest support 30 and base 12 between a disengaged position and an engaged position. The backrest support 30 includes a cam lock 310 that is moveable between a disengaged position, wherein the shaft 306 or pin is removable from the pocket 302, and an engaged position wherein the shaft 306 or pin is not removable from the pocket 302. The frame 20, flexible shell 202 and compliant component 204, or leaf spring, may be configured as components of a self-contained unit, wherein the frame 20 is the only component of the self-contained unit that is directly coupled to the tilt control mechanism 10, which includes the base 12, backrest support 30 and seat support 32/seat 6. The phrase "directly coupled" refers to a connection between two components such that those components move together at the point of connection, and may not be separated when directly coupled during the normal operation of the body support structure, meaning the sliding interface between the seat and compliant component does not constitute a direct coupling. At the same time, it should be understood that the direct coupling may be releasable, for example during assembly and disassembly of the body support structure. The connections, e.g., pivot axes 280, 208, between the upper portion of the shell 202 and the frame 20 and the lower portion of the shell and the compliant component 204 (e.g., leaf spring), which may or may not be pivotable connections, are the only connections between the shell 202 and the frame 20. In one embodiment, the shell 202 is free of any direct connection to the seat 6. For example, the seat 6 may intermittently engage, or slide along the compliant component 204 (e.g., leaf spring), by way of a sliding engagement between those components when pressed together, but those components are not directly connected, and may be separated, for example when the backrest is fully reclined, during the normal operation of the body support structure.

In one embodiment, a method of assembling the tilt control assembly includes providing a backrest 8 having a frame 20, a flexible shell 202 having an upper portion connected to the frame, and a compliant component 204, or leaf spring, connected to a lower portion of the flexible shell 202 at a first location and connected to the frame 20 at a second location. The method further includes releasably connecting the frame 20 to the tilt control mechanism 10, or base, for example by way of the backrest support 30, and establishing an intermittent sliding contact between the compliant component 204 (e.g., leaf spring) and a seat 6 coupled to the base 12. The lumbar compensator 200 may be completely integrated into the backrest assembly, thereby allowing for the backrest assembly to incorporate a "quick connect" feature.

Figure 17:
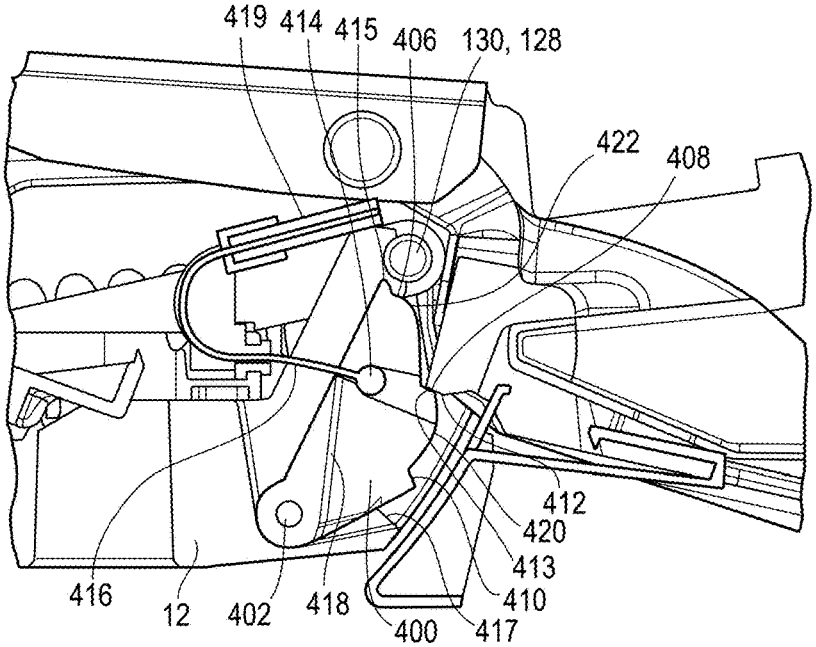
FIG. 17 is a partial, side view of the tilt control and backrest.

Referring to FIGS. 2 and 17, a variable back stop 400 is pivotally coupled to the base 12 about a pivot axis 402. The stop has three stop surfaces 406, 408, 410 that may be rotated such that they are engaged by a stop portion, or stop feature 412, disposed or formed on the backrest cross member 42. The stop feature may 412 may include an angled surface 413, which mates with the stop surfaces 406, 408, 410. In one embodiment, one edge or corner of the surface 413 engages the stop surface 406, 408, 410 first, such that the stop feature 412 drives or slightly rotates the back stop 400 into full engagement with the stop feature 412, or full engagement between the stop feature 412 and the stop surfaces 406, 408, 410. The back stop 400 may be pivoted about the pivot axis 402 to different positions, wherein one of a plurality of flat surfaces 406, 408, 410 may be engaged by and mate with the surface 413 of the stop feature 412 on the backrest support, which rotates relative to a base 12. This engagement limits the rear tilt of the backrest support 30 and backrest 8 connected thereto. A cable 416 may be disposed in a cable guide 419 and connected to a barrel 414 to pull the back stop rearwardly (counterclockwise) to a desired setting against the force of a return spring 418. When the cable 416 is released, the spring 418 biases/rotates the back stop 400 clockwise, for example into engagement with the back support.

The back stop 400 has transition surfaces 420, 422 (shown as two) defining steps or risers between flat surfaces or treads (shown as three) that define the stop surfaces 406, 408, 410. At least portions of the transition surfaces 420, 422 are curved, so as to allow or provide for the stop feature 412 of the backrest support 30 to slide along each curved surface between the flat surfaces without binding on the curved surface. In one embodiment, the upper portions of the transition surfaces 420, 422 are curved, while lower portions may be linear. In one embodiment, the curved portion may have a conic curvature. The curved portion of the surfaces 420, 422 smoothly transition to the flat stop surfaces 406, 408, 410, meaning a tangent of the curved surface may be substantially parallel to the flat surface at the junction thereof.

The backrest 8, which is pivotally coupled to the base 12 about the pivot axis 36, is pivotable relative to the base between an upright position and a reclined position, while the back stop 400 is pivotally coupled to the base about the pivot axis 402 spaced apart (and rearwardly and downwardly) from the pivot axis 36. The tangent of the curved transition surface 422 is within 0 and 30 degrees, or between 0 and 10 degrees and/or between 0 and 5 degrees in other embodiments, of the first stop surface 406 at a junction thereof. The stop may include a third stop surface 410, or more than three stop surfaces, wherein the second transition surface 420 extends between the second and third stop surfaces 408, 410. A second tangent of the curved portion of the second transition surface 420 is within 0 and 30 degrees, or between 0 and 10 degrees or even 0 and 5 degrees in other embodiments, of the second stop surface 408 at a junction thereof. The cable 416 has a first end coupled to the back stop 400 at a location, e.g., barrel 414, spaced from the pivot axis 402. Extension and retraction of the cable causes the back stop 400 to rotate about the pivot axis 402. The stop feature 412 on the backrest cross member 42 may engage a stop surface 417 defined on the base 12 when the backrest is in a fully reclined position. The back stop 400 includes an arm or lip 415 extending upwardly from the stop surface 406. The lip 415 engages and prevents the back stop 400 from rotating past the stop feature 412 of the backrest cross member 42 when the stop feature is engaged with the stop surface 406.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A tilt control system comprising:

a base;

a backrest pivotally coupled to the base about a first pivot axis, wherein the backrest is pivotable relative to the base between an upright position and a reclined position;

a spring adjuster coupled to the base and comprising a vertically moveable coupling component, wherein the coupling component is reciprocally moveable along a first direction; and a compression spring having a first end coupled to the coupling component and a second end coupled to the backrest, wherein the compression spring extends rearwardly from the first end in a second direction transverse to the first direction, wherein the compression spring is compressible between a first condition when the backrest is in the upright position and a second condition when the backrest is in the reclined position, wherein the second condition comprises a greater degree of compression than the first condition.

2. The tilt control system of claim 1 further comprising a link having a first end coupled to the coupling component and a second end coupled to the base, wherein the link extends rearwardly from the first end of the link in the second direction.

3. The tilt control system of claim 2 wherein the spring adjuster comprises a vertically extending shaft rotatably mounted to the base, and wherein the coupling component comprises a nut threadably engaged by the shaft.

4. The tilt control system of claim 3 wherein the first end of the link is pivotally coupled to the nut and the second end of the link is pivotally connected to the base.

5. The tilt control system of claim 1 further comprising a spring holder engaging the compression spring, the spring holder having a first component engaged by the first end of the compression spring and a second component engaged by the second end of the compression spring, wherein the first and second components are moveable relative to each other.

6. The tilt control system of claim 5 further comprising a third component bridging between the first and second components.

7. The tilt control system of claim 5 wherein the first component pivotally engages the coupling component.

8. The tilt control system of claim 7 wherein one of the first component and the coupling component comprises a concave surface and the other of the first component and the coupling component comprises a convex surface interfacing with the concave surface.

9. The tilt control system of claim 8 comprising a bearing disposed between and/or defining at least one of the convex and concave surfaces.

10. The tilt control system of claim 5 wherein the second component pivotally engages the backrest.

11. The tilt control system of claim 10 wherein one of the second component and the backrest comprises a concave surface and the other of the second component and the backrest comprises a convex surface interfacing with the concave surface.

12. The tilt control system of claim 10 wherein one of the second component and the backrest comprises an insert portion and the other of the second component and the backrest comprises an opening, wherein the insert portion is disposed in the opening.

13. The tilt control system of claim 1 further comprising a seat pivotally coupled to the backrest about a second pivot axis.

14. The tilt control system of claim 13 wherein the second pivot axis is positioned rearwardly of the first pivot axis.

15. The tilt control system of claim 14 wherein the seat is pivotally coupled to the base about a third pivot axis.

16. The tilt control system of claim 15 wherein the third pivot axis is slidably coupled to the base.

* * * * *